US012779275B1

(12) United States Patent
Kelly

(10) Patent No.: US 12,779,275 B1
(45) Date of Patent: Nov. 3, 2026

(54) VARIABLE STROKE FITNESS AND THERAPY SYSTEM

(71) Applicant: Bradley R Kelly, Langley (CA)

(72) Inventor: Bradley R Kelly, Langley (CA)

( * ) Notice: Subject to any disclaimer, the term of this patent is extended or adjusted under 35 U.S.C. 154(b) by 72 days.

(21) Appl. No.: 18/935,441

(22) Filed: Nov. 2, 2024

Related U.S. Application Data

(60) Provisional application No. 63/595,967, filed on Nov. 3, 2023.

(51) Int. Cl.
*A63B 21/08* (2006.01)
*A63B 21/00* (2006.01)

(52) U.S. Cl.
CPC ..... *A63B 21/08* (2013.01); *A63B 21/4047* (2015.10); *A63B 2225/093* (2013.01)

(58) Field of Classification Search
CPC ..... A63B 69/305; A63B 69/20; A63B 69/22; A63B 69/222; A63B 21/08
See application file for complete search history.

(56) References Cited

U.S. PATENT DOCUMENTS 5,437,590 A 8/1995 D'Alto
5,725,458 A 3/1998 Newman et al.
6,090,018 A * 7/2000 Laudenslager ..... A63B 69/305 482/90
11,395,949 B1 * 7/2022 Brown ..... F16F 1/12
2002/0010057 A1 1/2002 Bouvier
2006/0100067 A1 5/2006 Washburn et al.
2010/0179031 A1 7/2010 Luigi
2011/0111928 A1 * 5/2011 Tsakiris ..... A63B 69/305 482/87
2014/0106940 A1 4/2014 Zimmerman
2015/0011366 A1 1/2015 Hockridge et al.
2016/0166910 A1 * 6/2016 Adams, Jr. ..... A63B 67/10 482/86
2018/0290007 A1 * 10/2018 Vorozilchak ..... A63B 21/06
2019/0118059 A1 4/2019 Partlo
2021/0178241 A1 6/2021 Jones
2021/0402276 A1 12/2021 Peyton
2023/0067901 A1 * 3/2023 Luigi ..... A63B 69/20
2025/0073555 A1 * 3/2025 Yoabov ..... A63B 69/20

FOREIGN PATENT DOCUMENTS

DE 19722987 A1 * 12/1998 ..... A63B 69/22

* cited by examiner

*Primary Examiner* — Joshua T Kennedy
(74) *Attorney, Agent, or Firm* — Advantage IP Law Firm; Michael S Doll

(57) ABSTRACT

A variable stroke fitness and therapy system that incorporates a pendulum bob with an external padded surface suspended from an elongated suspension system responsive to rotation of the pendulum bob to change length, the suspension system further having at least one locking mechanism constructed to selectively define at least one swing arc through which the pendulum bob may swing while suspended from the suspension system.

20 Claims, 26 Drawing Sheets

VARIABLE STROKE FITNESS AND THERAPY SYSTEM

CROSS-REFERENCE TO OTHER APPLICATIONS

This application claims the benefit of U.S. Patent Application No. 63/595,967, filed on Nov. 3, 2023 and entitled the same, which is hereby incorporated by reference in its entirety.

BACKGROUND OF THE DISCLOSURE

1. Field of the Disclosure

This present disclosure relates broadly to fitness and therapy equipment. More specifically, this disclosure relates to a suspended mass that may be interacted with to conduct sports motion training as well as fitness training and therapeutic rehabilitation that focus on a variety of activities including those that improve stability and proprioception—the body's ability to sense movement, action, and location.

2. Background Art

Most strength and cardio building activities taking place in a fitness or rehabilitation center require the use of a machine or, alternatively, free weights and other non-machine devices. The machine based devices are typically constructed of heavy metal tubing providing a frame with handles connected to a series of pulleys and weighted plates that may be selectively stacked to increase or decrease the resistance. The weighted plates are typically locked in place by a pin. However, such devices are often complicated requiring the assistance of a trainer, especially when first encountering the machine, and often dangerous due to the lack of safety features and the relatively large moving masses and rapidly moving push and pull bars that may damage the user if there is a slip or inadvertent release. In addition, such machines are often tailored to a specific motion and allow users to focus on a particular muscle set or exercise routine. To go through a series of different strength building exercises, the user must transfer from machine to machine. This requires a large amount of space to accommodate a significant number of machines.

Other resistance based machines omit the weighted plates and instead use a variety of bendable rods attached to the pulley system. By incorporating a variety of bendable rods attached at various locations on the main bench of the machine, the user may perform a variety of exercises on one device. However, as with the weighted plate machines, there is typically a bench to support the user and the user is typically stationary during use only moving their arms or legs accordingly in conjunction with what the machine allows. Thus, the user's body stability and sense of awareness in space is not challenged.

Free weights, on the other hand, have the advantage of avoiding the use of the large machine framework. Such weights take up less room and allow the user to move about the location if the weights are handheld. Often, the free weights are used in conjunction with a weightlifting bench which also limits the user's movement similar to the machine constructions. As with the machines, the free weights may also pose similar dangers when the plate holding bar becomes unbalanced, the plate locking mechanisms release prematurely, or the weight is dropped.

On the other hand, there are a variety of non-machine devices with a different focus that require the user to develop concentration and hand-eye coordination. One example of such a non-machine device is a freestanding device with a weighted bottom component that is balanced to return to an upright equilibrium position once pushed or driven out of the upright equilibrium position. Such devices are often referred to a bounce back devices and often used in boxing, martial arts, and self-defense classes. Such devices are notorious for sliding around, when not anchored to the floor or not heavy enough to resist the sliding motion after being struck, forcing the user to chase the bounce back device around or constantly move the object back into place. In addition, such devices are mainly for punching and kicking and not much use for facilitating other activities.

Other examples of non-machine exercise and training devices are the speed bag and the heavy bag. The speed bag is typically suspended from an overhead support such as an enlarged wooden disc or metal frame by a relatively short chain and offers a moving target once set in motion. Such apparatus requires significant focus and hand-eye coordination to enter into a rhythm and maintain the speed bag in motion without missing a strike or striking the bag off center to create an unpredictable motion that results in a subsequent missed strike. The overhead wooden disc or frame provides a backstop for the speed bag to bounce off and return toward the user. A variation of the overhead mounted speed bag is the double ended speed bag or floor to ceiling speed bag. This bag moves more unpredictably than the frame mounted speed bag and more realistically simulates a real fight. Such bag further challenges the user's hand-eye coordination to maintain frequent contact but is generally restricted in space and mainly used for punching and kicking routines such as would occur in boxing or mixed martial arts.

On the other hand, the heavy bag is typically presented as an elongated cylindrical bag suspended by a chain or strap attached to a hook attached to an overhead support. In most instances the bag is filled with sand or sawdust, although other materials such as shredded fabric or rags, foam, or water may also be used. Overall, the choice of a single filling type of mixture of filling materials depends on the desired resistance and impact. As the user strikes the sides of the heavy bag, the sides are crushed inwardly depending on the amount of give in the filling material along with the strength and accuracy of the user. The bags are constructed to travel a very limited distance so as to remain close to the user to allow for repetitive strikes.

Both the speed bag and heavy bag mainly focus on punching related activities and interacted with hands or feet. In addition, both the overhead suspended speed and heavy bags are also fixed in height and only swing from a single pivot point thus limiting their range of motion and further limit the activities one can perform using such devices to basically punching, striking, and kicking activities. In addition, as the overall stroke of the swing of such devices cannot be varied, limits are placed on the type of activities one can perform as well.

Given the drawbacks to the fitness and rehabilitation devices described above, there exists a need for a fitness and therapy device that can replace a number of different fitness and rehabilitation type equipment, seamlessly accommodate the flow of one routine to another, enable push and pull based routines and athletic motion training in addition to striking activities on a swinging mass, and incorporate height altering and stroke variation capabilities while encouraging the user to develop stability and balance, strength, cardio fitness, and an awareness in space during use.

SUMMARY OF THE INVENTION

In accordance with the principles of the present invention, at least one embodiment of a variable stroke fitness and therapy system may comprise a pendulum bob having an elongated body with at least one external padded sidewall surface and a top surface, the pendulum bob being constructed to be suspended from an overhead support structure via an elongated suspension system having a first end removably coupled to the top plate of the pendulum bob and an opposing end for removably coupling to the support structure to suspend the pendulum bob, the suspension system being responsive to rotation of the pendulum bob to change length.

In at least one other embodiment of the variable stroke fitness and therapy system, the suspension system may include at least one locking mechanism constructed to selectively define at least one swing arc through which the pendulum bob may swing while suspended from the suspension system as well as vary the resistance imparted by the pendulum bob.

In yet another embodiment of the variable stroke fitness and therapy system, the suspension system may include a set of locking mechanisms to selectively define a plurality of pivot points, all of which may be locked or unlocked to vary the swing arc through which the pendulum bob may swing while suspended from the suspension system as well as vary the resistance imparted by the pendulum bob.

In at least one embodiment of the variable fitness and therapy system, the pendulum bob or workout form is a substantially hollow basket with an exterior padded surface and a top plate for coupling to the suspension system.

In another aspect of the variable fitness and therapy system, the suspension system includes an extension and retraction sleeve constructed to receive at least a portion of a support rod with the extension and retraction sleeve and support rod being rotatable relative to one another to extend or retract in a telescopic relationship as the pendulum bob is rotated.

In yet another aspect of the variable fitness and therapy system, the pendulum bob includes a plurality of spaced apart anchor points for interacting with the pendulum bob using one or more accessories.

Methods for suspending and using the variable stroke fitness and therapy system are also disclosed herein.

All of the embodiments summarized above are intended to be within the scope of the invention herein disclosed. However, despite the discussion of certain embodiments herein, only the appended claims (and not the present summary) are intended to define the invention. The summarized embodiments, and other embodiments and aspects of the present invention, will become readily apparent to those skilled in the art from the following detailed description of the preferred embodiments having reference to the attached figures, the invention not being limited to any particular embodiment(s) disclosed.

DETAILED DESCRIPTION OF THE PREFERRED EMBODIMENTS

In general terms, embodiments of a variable stroke fitness and therapy system and methods of using the same are disclosed herein. In the examples given, the variable stroke fitness and therapy system may be suspended from an overhead support resulting in a fixed or free swinging pendulum bob or workout form that may be used to conduct a large number of interactive routines replacing the need for a number of machines and devices typically used in exercise, fitness, or therapy routines while also providing a much safer alternative that accommodates athletic training, martial arts training, fitness and exercise regimens, and therapy routines. Such variable stroke fitness and therapy system is highly responsive to interaction from a user even while the user is assuming a standing, sitting, crouched, kneeling, or prone position. Moreover, by varying the distance from the bag, the user may encounter variable resistance and balance stabilization challenges as the free swinging bag moves toward and away from the user who may interact with the bag directly or indirectly through one or more accessories attached to the bag. Such a variable stroke fitness and therapy system further enables the user to flow seamlessly through a series of resistance and stability transitions to alter the momentum and the perceived weight of the bag resulting in both aerobic and anaerobic based activities.

Figure 1:
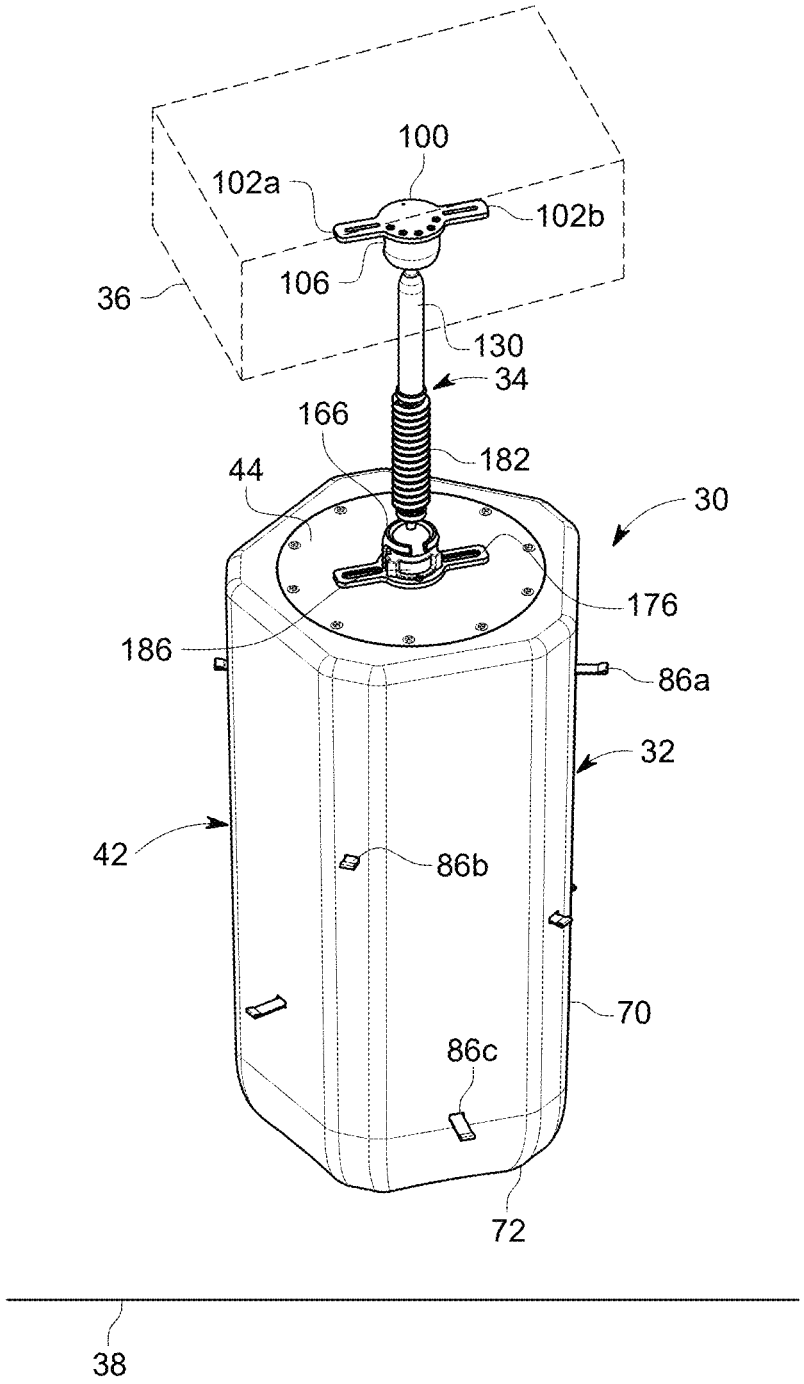
FIG. 1 is a perspective view of an exemplary embodiment of a variable stroke fitness and therapy system including a multi-pivot suspension system and a pendulum bob suspended from an overhead support structure in an extended plumb position.
Figure 2:
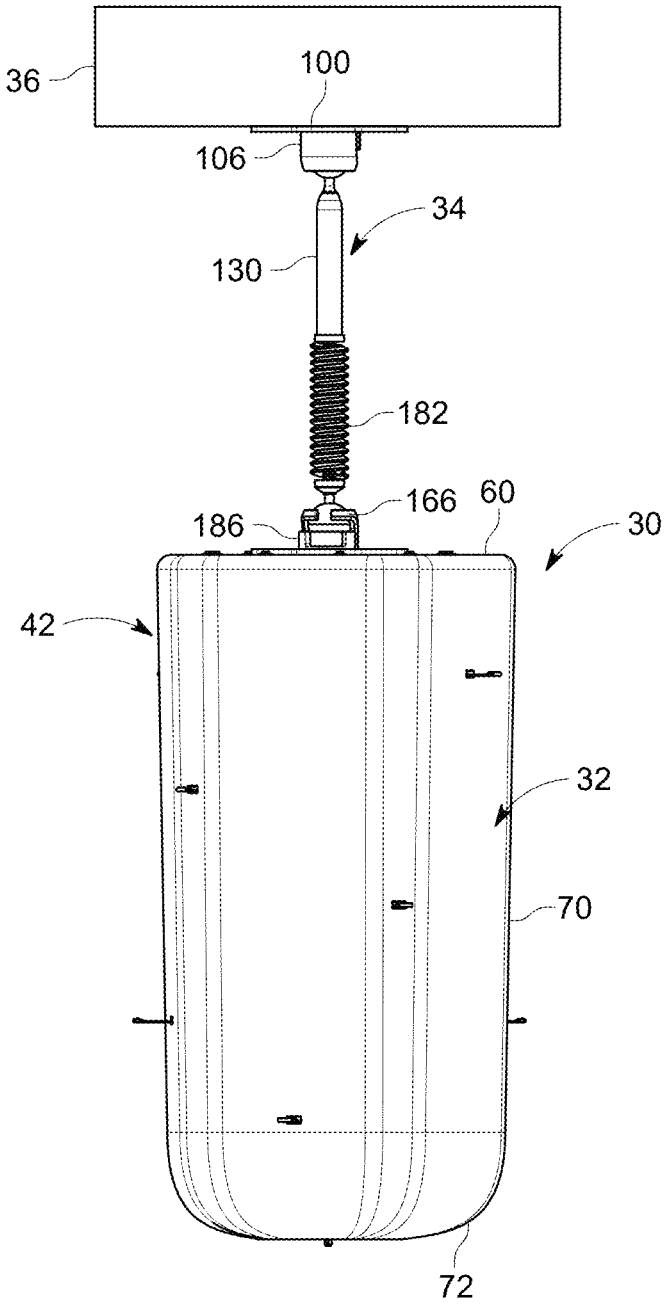
FIG. 2 is a front view of the variable stroke fitness and therapy system of FIG. 1.
Figure 3:
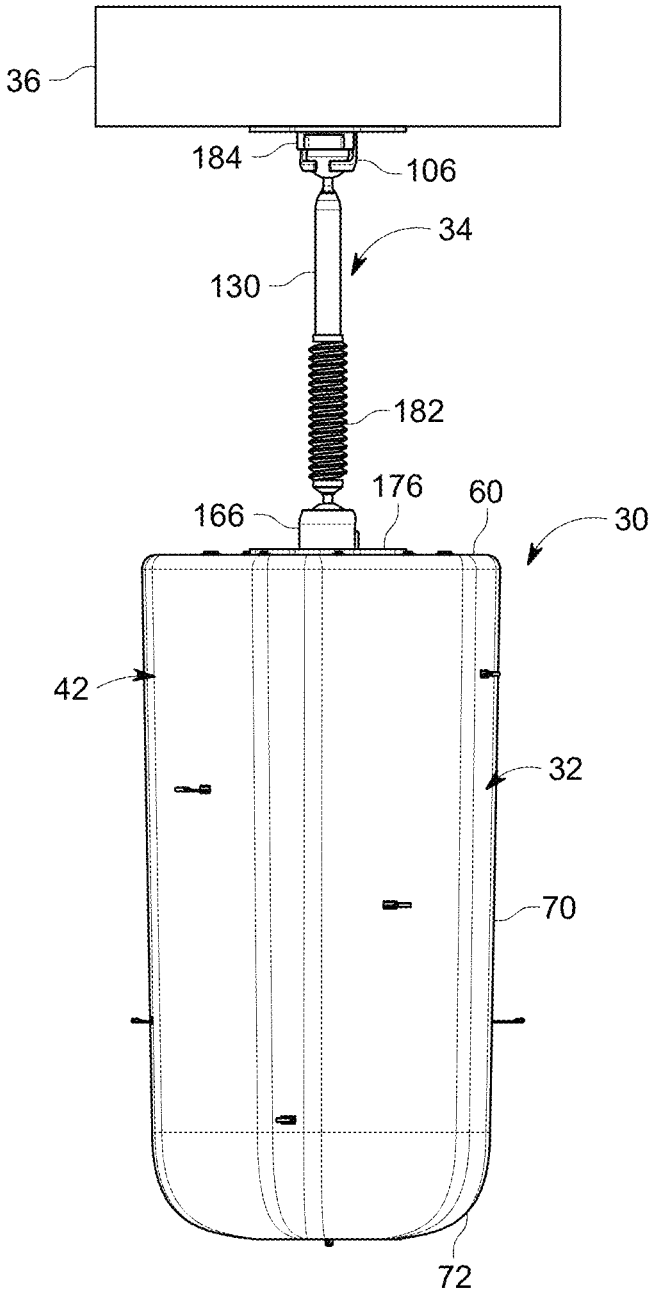
FIG. 3 is a rear view of the variably stroke fitness and therapy system of FIG. 1.
Figure 4:
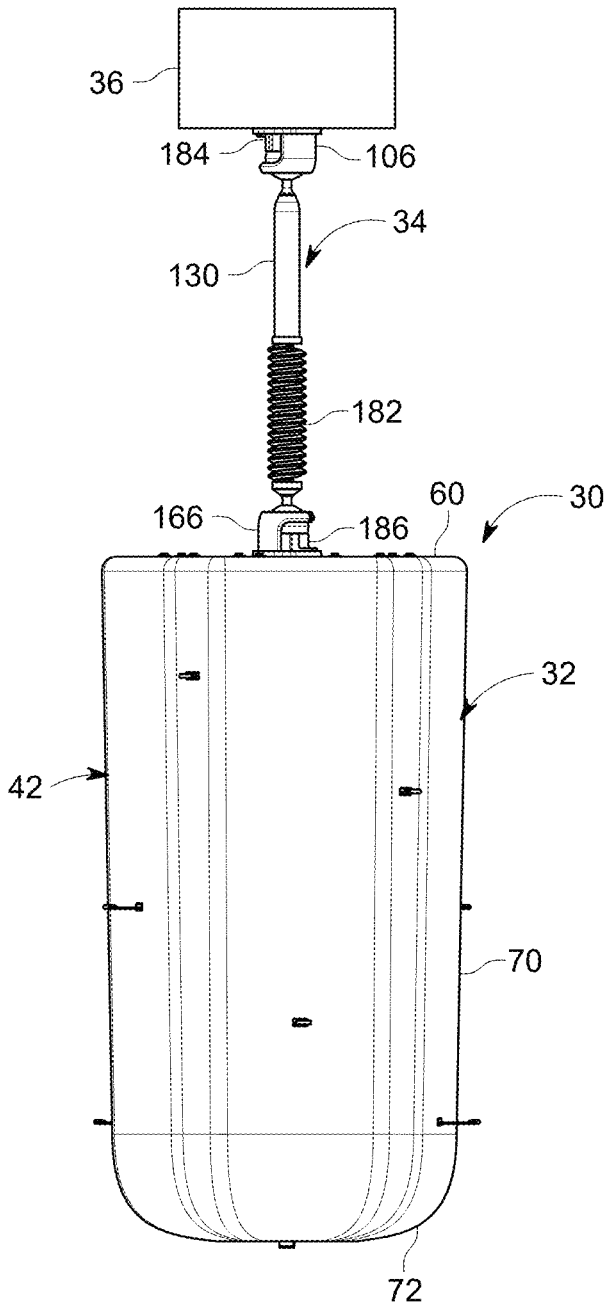
FIG. 4 is a left hand view of the variable stroke fitness and therapy system of FIG. 1.
Figure 5:
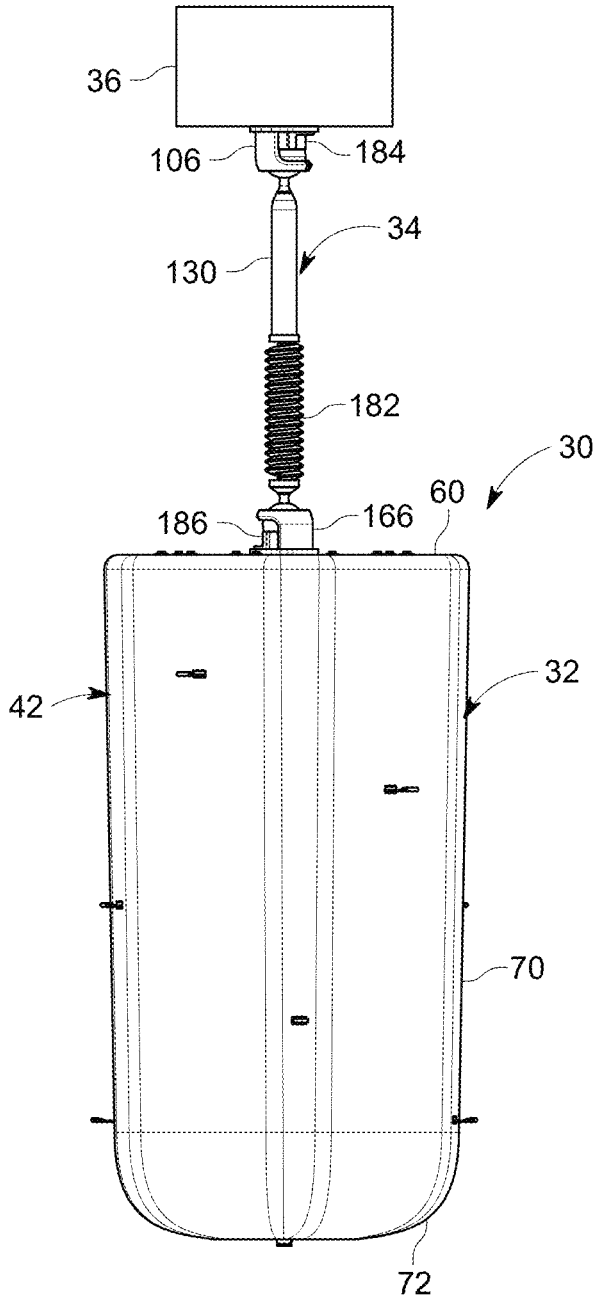
FIG. 5 is a right hand view of the variable stroke fitness and therapy system of FIG. 1.

Referring more specifically to FIG. 1, a variable stroke fitness and therapy system, generally designated 30, incorporates an interactive fitness and therapy pendulum bob, generally designated 32 and also referred to as the workout form, workout mass, or pendulum body, which is releasably coupled to a multi-pivot suspension system, generally designated 34, which is in turn may be coupled to an overhead support structure 36, depicted in dashed lines, to suspend the pendulum bob above a relatively flat workout surface 38. In general terms, the upper support structure defines a point of suspension, the suspension system defines the length, and the workout form defines the mass of the pendulum-based workout system 30 with the suspension system further providing multiple pivot points about which the workout form may swing from as well as a length changing capability. It will be appreciated that while a joist set, beam, reinforced ceiling, or tubing or pipe may provide a satisfactory overhead support structure, the entire overhead support structure does not have to be directly above the system and may include a cantilevered or laterally projecting component, including, but not limited to, a tree branch or structure mounted to a vehicle.

Figure 6A:
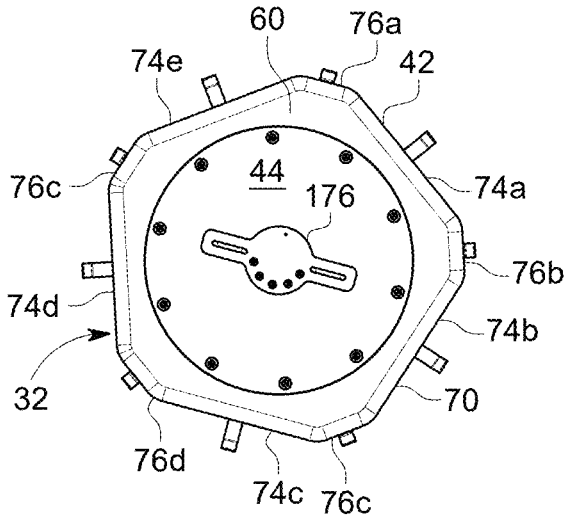
FIG. 6A is a top view of the variable stroke fitness and therapy system of FIG. 1 without the overhead support structure.
Figure 6B:
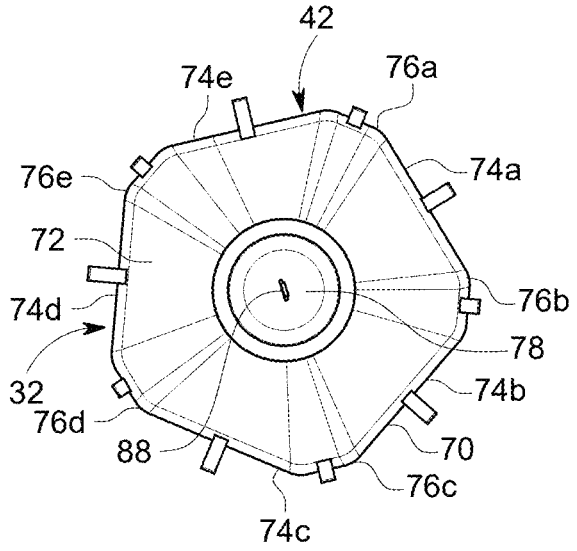
FIG. 6B is a bottom view of the variable stroke fitness and therapy system of FIG. 1 without the overhead support structure.
Figure 7:
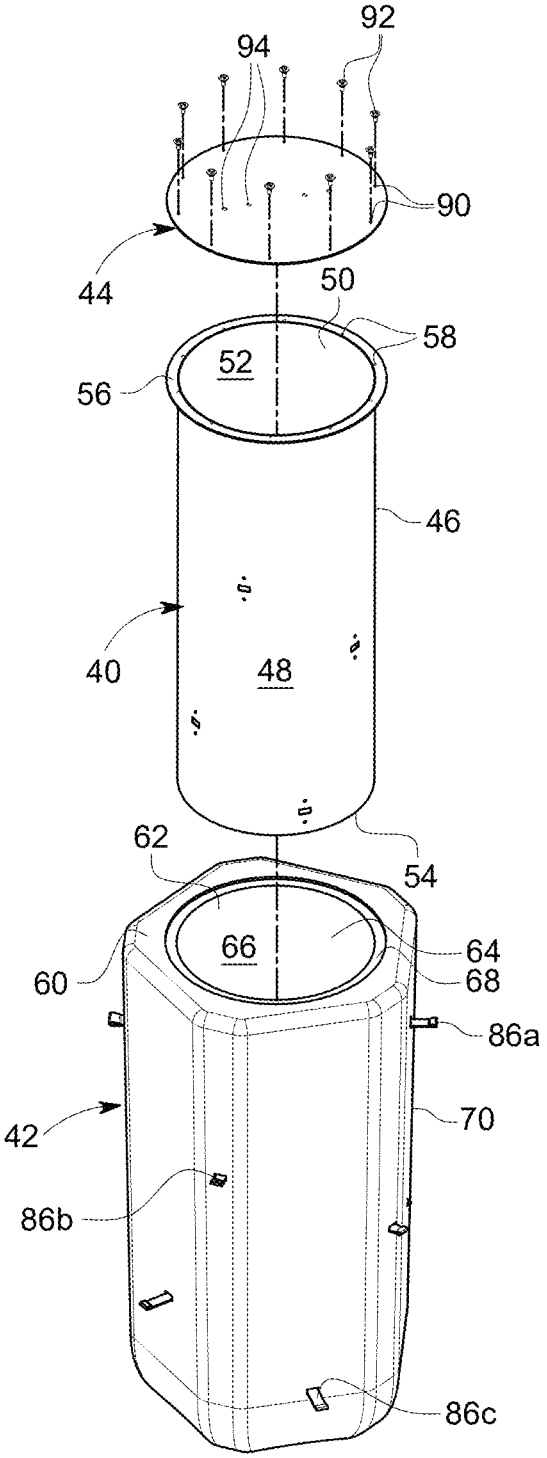
FIG. 7 is an exploded view of the pendulum bob from FIG. 1 without the multi-pivot suspension system.

Turning now to FIGS. 1-7, the pendulum bob 32 or variable stroke workout form that is supported by and suspended from the overhead support structure 36 by the multi-pivot suspension system 34 will now be described in more detail. As best shown in FIG. 7, the pendulum bob 32 has three primary components including a steel core basket 40, an outer shell 42, and a top plate 44. The steel core basket is a generally cylindrically shaped body 46 with an outermost surface 48 and a large hollow interior cavity 50 defining an interior surface 52. The basket further includes a flat bottom surface 54 and an uppermost flange 56 bearing a set of fastener throughbores 58 around the upper perimeter of the basket. Surrounding the cylindrical body 46 and the bottom surface 54 of the basket 40 is the outer shell 42 preferably constructed of a self-skinning foam pad. The outer shell pads the steel core basket and provides a cushioned surface that the user may interact with. The outer shell includes an uppermost surface 60 defining an opening 62 into a large cavity 64 with an interior surface 66 for receiving the main body 46 of the basket 40. A narrow lip 68 recessed from the top surface 60 of the outer shell provides a seat for the uppermost flange 56 of the basket 40. The interior surface 66 of the outer shell 42 is constructed to fit snugly against the outermost surface 48 and bottom surface 54 of the basket 40 so as not to slip during use. While it is preferred that the outer shell 42 substantially surrounds the sidewall and bottom of the basket defining the outermost surface 48 of the basket 40, this is not meant to be limiting, and the shell may encompass multiple sections or pieces and also cover less than the entire sidewall and bottom of the basket.

Continuing on with FIGS. 1-7, an exterior sidewall surface 70 and the bottom surface 72 of the outer shell 42 depart from the traditional cylindrical perimeter and flat bottom exterior of a conventional heavy bag. As best shown in FIGS. 6A-6B, in contrast to a cylindrical heavy bag, the outer shell 42 has a substantially ten-sided top and bottom profile alternating between wide and narrow panels. More specifically, the exterior sidewall surface 70 of the outer shell 42 is multi-faceted with a set of five wide panel sections 74*a-e* spaced apart with five narrow panel sections 76*a-e* interposed therebetween. As depicted in the side views as in FIGS. 2-5, the outer shell also tapers inwardly from the top surface 60 of the outer shell to the bottom surface 72. The bottom surface 72 also includes a central circular well 78. Such well may incorporate an electronics suite with motion and/or location sensors with transmission capabilities for monitoring movement of the pendulum bob in use and providing feedback to the user. Such electronics suite may communicate with a remote device such a mobile phone, laptop, desktop, electronic pad, or other suitable electronic device for recording and displaying pendulum movement activities.

Figure 8:
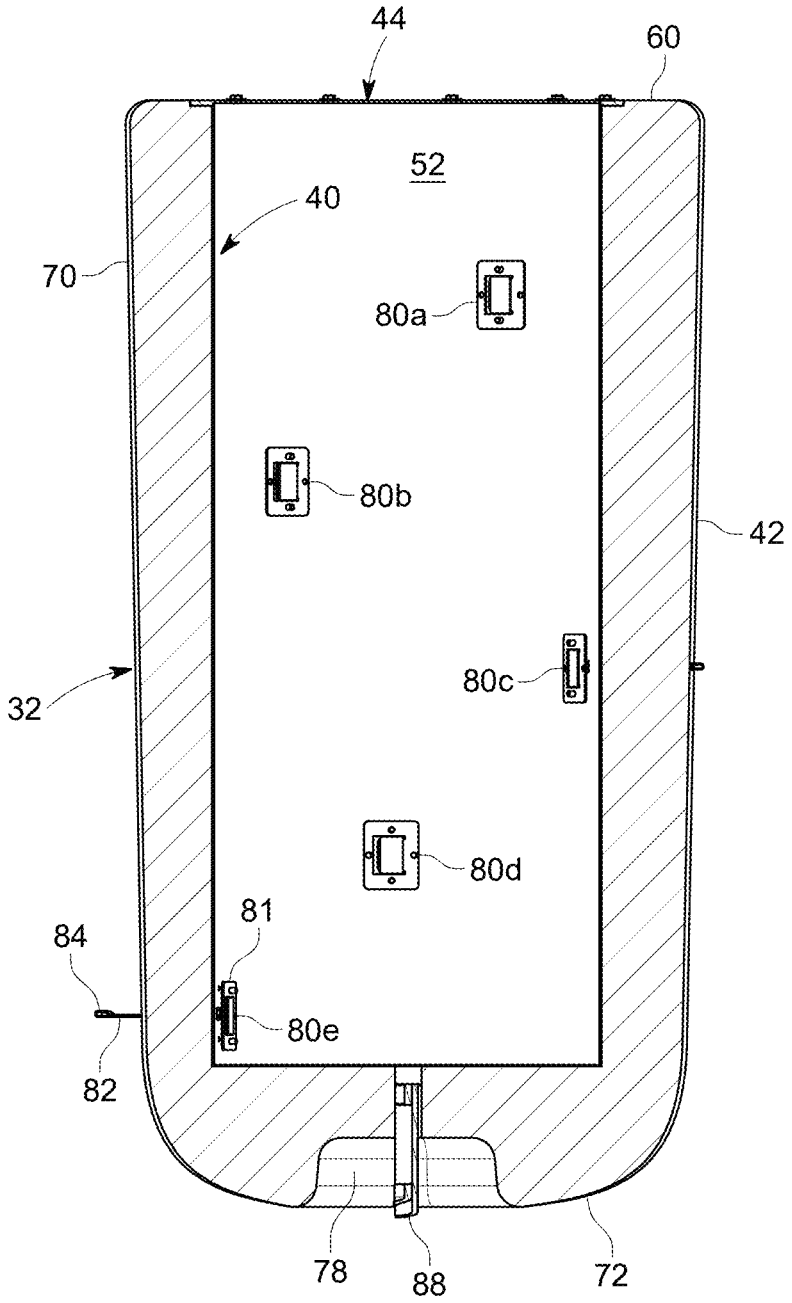
FIG. 8 is a cross-sectional view taken from a vertical plane passing through the pendulum bob depicting the hollow interior and the internal anchor plates for securing the anchor straps.

As shown in FIG. 8, the interior surface 52 of the basket 40 includes a series of spaced apart anchor plates 80*a-e* with each of the anchor plates securing the inner end 81 of an anchor strap such as that exemplified by reference numeral 82. The anchor strap 82 then extends through the outer shell 42 to dispose the outer end 84 of the anchor strap on the exterior surface (70 or 72) of the outer shell. The outermost ends of the anchor straps provide a loop or "pick point" for attaching various accessories to interact with the pendulum bob 32 as described below. In addition, the pick points may serve as targets or focus points during striking drills and may also have a contrasting color relative to the wide and narrow panel background for a more obvious target.

As shown in FIG. 1, for example, the outer ends of the anchor straps are spaced about the exterior sidewall surface 70 of the outer shell 42 with at least one appearing in each panel, both wide and narrow to provide a number of accessory attachment points about the exterior surface 70 of the outer shell 42. Overall, there is typically a high anchor strap, an intermediate anchor strap, and a low anchor strap as exemplified by representative reference numerals 86*a*, 86, b, and 86*c*, respectively. The straps may be recessed into the outer shell 42 for concealment or retracted therefrom to expose their outer end loops for attachment to various accessories discussed below. In addition, there is an anchor strap 88 exposed in the bottom recess 78 of the outer shell. It will be appreciated that the tapering feature of the outer shell 42 from top to bottom with a narrower bottom region provides additional room for conducting leg-based exercises when secured to a lower 86*c* or a bottom anchor strap 88.

Turning back to FIG. 7, the top plate 44 is a relatively flat disc with a set of peripherally disposed throughbores 90 that are constructed to complement and align with the throughbores 58 of the flange 56 when mounted thereon. The top plate may then be fastened to the basket 40 using a set of complementary bolts 92 or other suitable fasteners. The top plate 44 further includes a set of bracket fastening bores 94 to receive complementary fasteners to couple the pendulum bob 32 to the suspension system 34 as described in more detail below.

Figure 9:
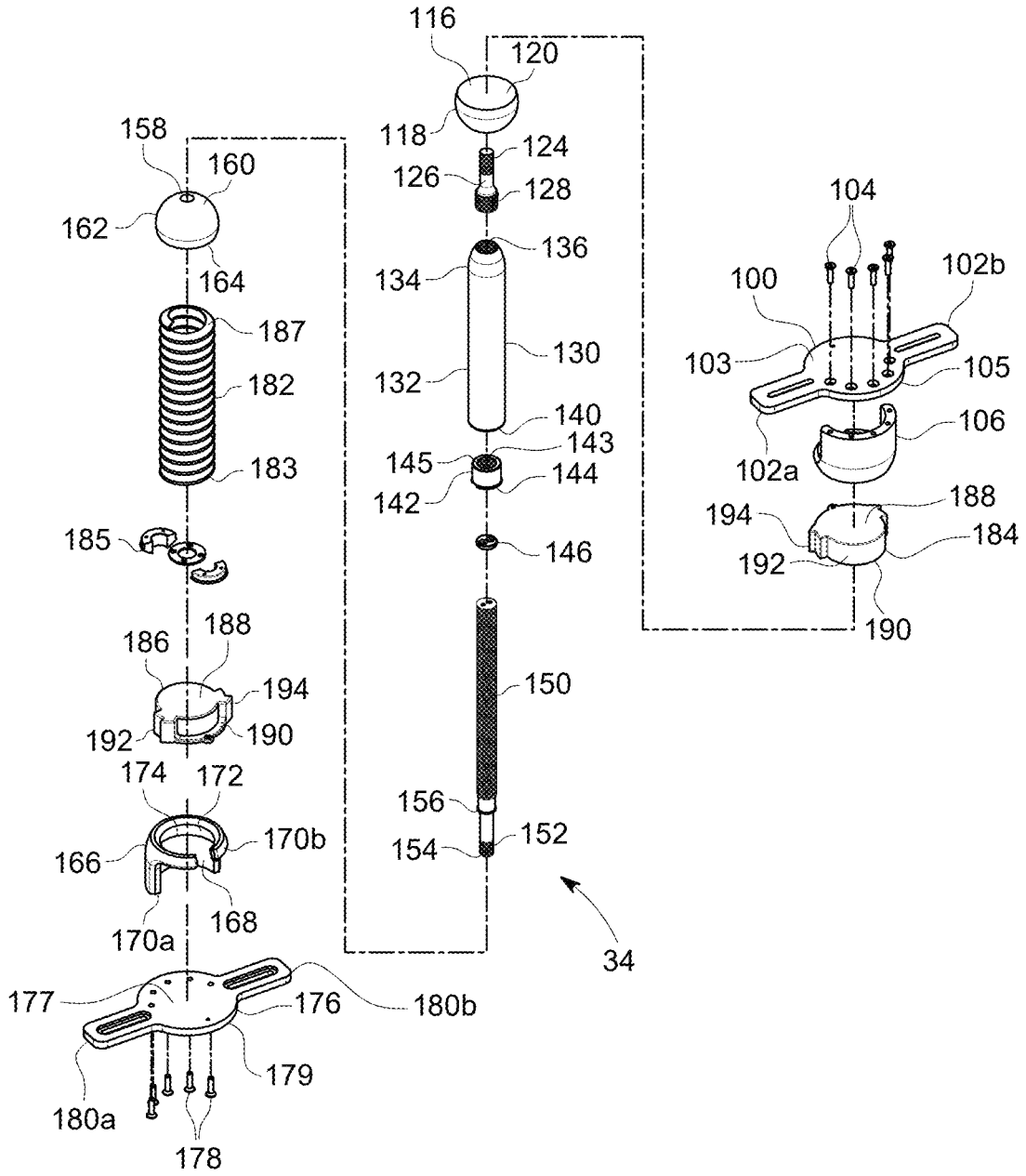
FIG. 9 is an exploded view of the multi-pivot suspension system of FIG. 1 without the pendulum bob.
Figure 10A:
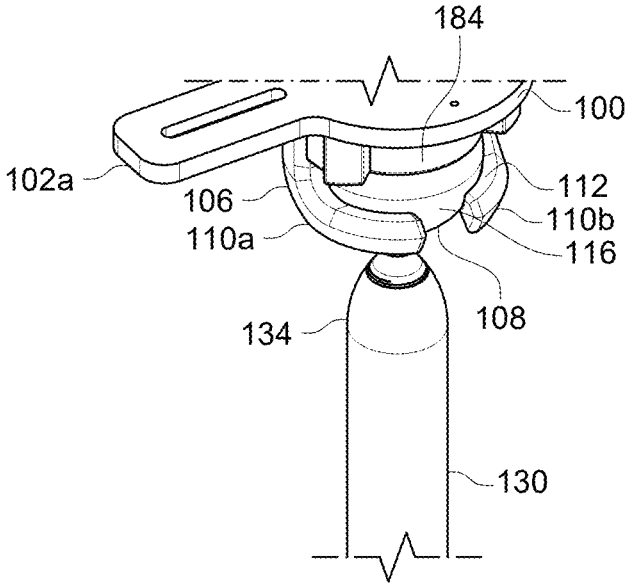
FIG. 10A is a close up view of the upper portion of the multi-pivot suspension system with an upper puck inserted into an upper socket.
Figure 10B:
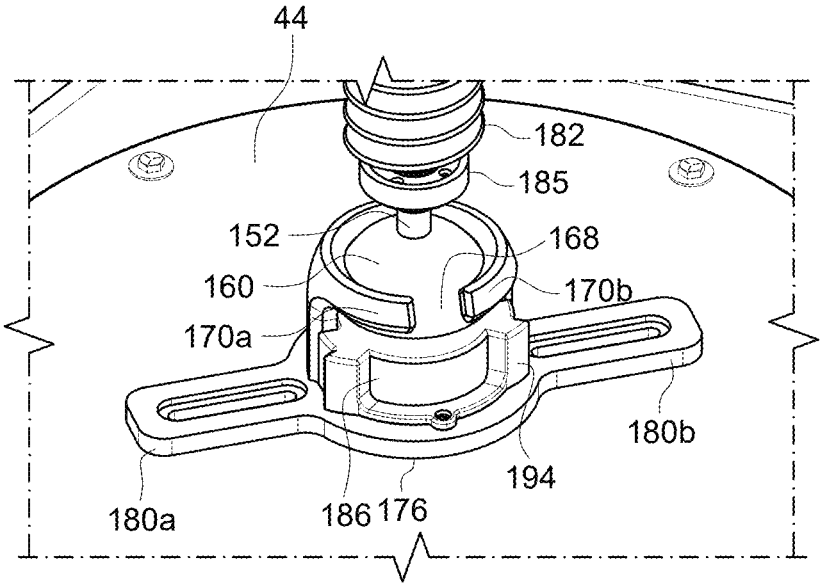
FIG. 10B is a close up view of the lower power of the multi-pivot suspension system with a lower puck inserted into a lower socket.
Figure 11:
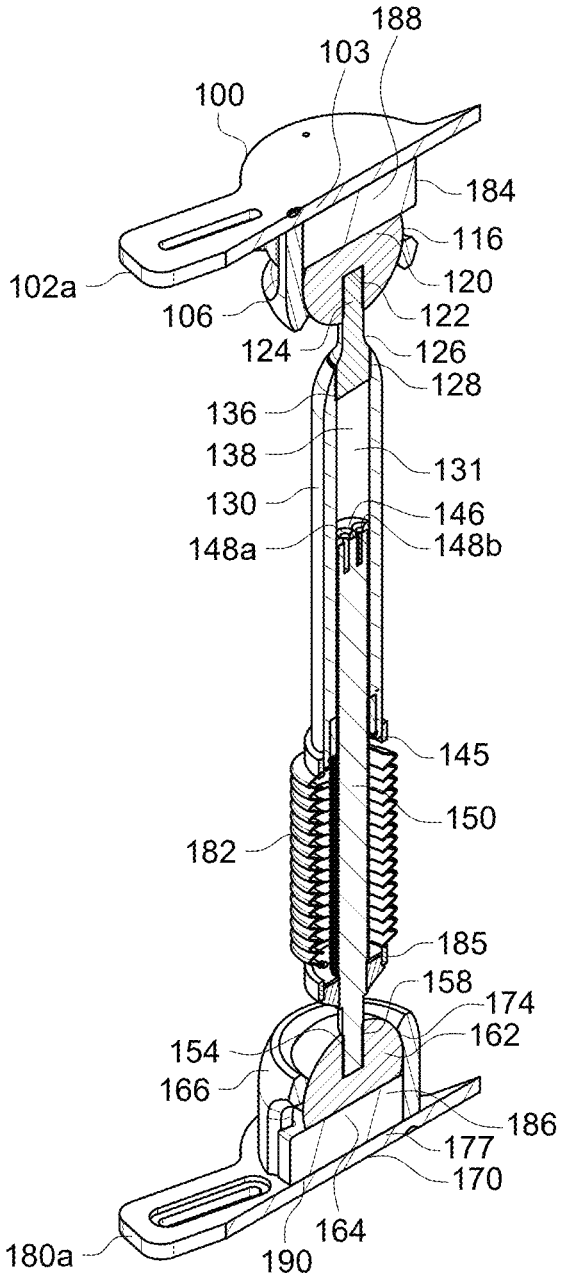
FIG. 11 is a cross-sectional view taken from a vertical plane passing through the assembled multi-pivot suspension system of FIG. 1 depicting the component relationships in a partially retracted position.

Turning to FIGS. 9-11, the multi-pivot capable suspension system 34 shown in FIGS. 1-7 incorporates a number of components allowing for the suspension system to couple to the overhead support structure 36 as well providing a fixed support for the pendulum bob 32, or alternatively, a plurality of pivot points that may be selected to vary the stroke length and available range of motion of the pendulum bob. The suspension system 34 also provides a rotational or spinning feature enabling a user to extend or retract the suspension system relative to the overhead support structure 36 (FIGS. 1-5) to vary the height of the pendulum bob 32 relative to the floor 38 (FIG. 1) providing yet another range of motion variation.

Continuing with FIGS. 9-10B, the suspension system 34 incorporates an upper support plate 100 with a pair of slotted wings 102*a*, 102*b* through which a set of bolts or other suitable fasteners may be inserted to secure the upper support plate to the overhead support structure 36 (FIGS. 1-5) such as a ceiling, support bracket, joist, or other suitable support constructed to support the weight and swinging motion of the variable stroke fitness and therapy system 30. The upper surface 103 of the upper support plate is flat as is the opposing lower surface 105 of the upper support plate. Secured by another set of bolts 104 to the upper support plate 100 is an upper socket 106 in the form an L-shaped hook with an opening 108 (FIG. 10A) in its sidewall to position two spaced apart capturing arms 110*a*, 110*b*. The interior surface 112 of the hook is curved inwardly with a smooth surface to form a nesting seat 114. Alternatively, the upper socket 106 and the upper support bracket 100 may be a unitary piece or welded together avoiding the need for fasteners.

With reference to FIGS. 9-11, for placement into the upper socket 106 within the nesting seat 114 is an upper ball member 116. The upper ball member is hemispherical in shape with the curved portion 118 facing downwardly and the flat surface 120 facing toward the lower surface 105 of the upper support bracket 100, when installed. Partially penetrating into the upper ball member through the curved portion 118 is a threaded receptacle 122 (FIG. 11). Inserted into the threaded receptacle is the externally threaded top end 124 of a relatively short support rod 126. The enlarged diameter lower end 128 of the support rod also includes an externally threaded region. Threaded onto the lower end 128 of the support rod 126 is an extension and retraction sleeve 130. The extension and retraction sleeve is a generally bullet shaped device with a hollow interior 131 (FIG. 11) passing through a cylindrical main body 132 and inwardly tapering upper end 134 forming the upper nose of the extension and retraction sleeve 130. The nose section 134 includes an inwardly threaded region 136 (FIG. 9) that is complementary to the externally threaded region 124 of the short support rod 126. The interior surface 138 (FIG. 11) of the hollow section below the inwardly threaded region 136 is substantially smooth walled. Slip fit into the lower end 140 of the extension and retraction sleeve 130 is a nut 142 with an outermost smooth wall and internally threaded section 143 (FIG. 9). The nut is held in place but a snap ring 144 anchored into a recess 145 (FIG. 11) set into the smooth walled interior surface 138 of the extension and retraction sleeve near the lowermost end 140. Alternatively, the bottom end 140 of the extension and retraction sleeve 130 may include another threaded region to receive a nut with both internal and external threading removing the need for the snap ring. Between the opposing threaded ends in such alternative, the hollow interior surface 138 of the extension and retraction sleeve 130 would be substantially smooth walled as well.

Continuing with FIG. 9, spaced beneath the nut 142 is a washer 146 with a set of opposing top end countersunk holes 148*a*, 148*b* (FIG. 11). The washer sits atop and is screwed into a long threaded lower support rod 150 which includes an externally threaded region along a majority of its length. The threading of the lower support rod is selected to complement the internal threading 143 of the nut. As the lower support rod 150 travels through the hollow interior 131 of the extension and retraction sleeve 130 in a threaded telescopic arrangement, the washer 146 acts as a bottom travel limiter and prevents the lower support rod 150 from being completely withdrawn from the extension and retraction sleeve preventing complete separation as a safety feature. The hollow interior 131 of the extension and retraction sleeve 130 is constructed to receive a length of the lower support rod 150 as the lower support threads upwardly into the extension and retraction sleeve.

Still referring to FIGS. 9-11, the bottom end 152 of the lower support rod 130 includes a reduced diameter externally threaded section 154 with a free spinning flange 156 acting as a seat for receiving a locking collar 185 to secure the bottom end 183 of a compression and expansion sleeve 182. This threaded section 154 is threaded into a threaded receptacle 158 in the uppermost most rounded surface 160 of a lower ball member 162, also hemispherically shaped with a lowermost flat surface 164 facing the floor when installed and suspended in a vertical position. In turn, the lower ball 162 is nested within a lower socket 166 constructed similarly to the upper socket 106 as described above, although in an inverted orientation, in the form an L-shaped hook with an opening 168 (FIGS. 9 and 10B) in its sidewall to position two spaced apart capturing arms 170*a*, 170*b*. The interior surface 172 of the lower socket 166 is also curved inwardly with a smooth surface to form a nesting seat 174 for the curved portion of the lower ball member 162. The lower socket 166 is fastened to a pendulum bob attaching bracket 176 using a set of bolts 178, screws, or another suitable fastening device. The upper surface 177 of the pendulum bob attaching bracket 176 is flat as is the lower surface 179 of the pendulum bob attaching bracket. Alternatively, the lower socket 162 and the lower bracket 176 may be a unitary piece or welded together avoiding the need for fasteners. The pendulum bob attaching bracket 176 includes a set of opposing slotted wings 180*a*, 180*b* or flanges for securing to the top of the pendulum bob 32 as discussed further below. Slipped over the lower support rod 150 is an accordion pleated compression and expansion sleeve 182 that compresses as the lower support rod is threaded up into the extension and retraction sleeve 130 as shown in FIG. 11, for example, and expands as the lower support rod is threaded out of the extension and retraction sleeve as shown in FIGS. 1-5, for example. The lower end 183 of the compression sleeve 182 is captured by a locking collar 185 that is coupled to the lower end 154 of the lower support rod 150 about the free spinning flange 156 of the lower support rod 150 while the upper end 187 of the compression sleeve may be secured to the extension and retraction sleeve 130 with a zip tie, adhesive, or other suitable fastening device. Such compression and expansion sleeve protects the exposed lower support rod and may also provide a visual indicator of how far the lower support rod 150 is threaded into the extension and retraction sleeve 130.

With continued reference to FIGS. 9-11, another component that may be used in the suspension system 32 is a set of upper and lower locking pucks 184, 186, respectively. The pucks are constructed identically and are interchangeable. Each puck 184, 186 includes a flat upper surface 188 and a flat lower surface 190 and a generally cylindrical body 192 with a pair of wings 194 providing favorable purchase for inserting and retrieving the puck from a respective socket 106, 166. Each puck is constructed to be inserted into upper or lower socket 106, 166, respectively, between the flat surface 120, 164 of the respective upper or lower ball member 116, 162 and a proximate flat surface 105, 177 of the respective upper and lower bracket 100, 176. Inserting a puck 184, 186 into a ball and socket assembly effectively provides a locking mechanism that locks the ball and socket assembly in place preventing the suspension system from tilting about the locked location resulting in an upper tilt capable system if the only the lower puck is installed, a lower tilt capable system if only the upper puck is installed, or a dual tilt capable system if no pucks are installed, all of which may change the stroke (pendulum swing length) and related swing angle range of the pendulum bob 32. By effectively locking one of the ball and socket assemblies, there is a significant load transfer to the open end (unlocked ball and socket assembly). This enables the pendulum bob 32 to impart an increased resistance if the bottom puck is installed or a decreased resistance if the top puck is installed thus introducing a variable resistance aspect into the system. While one or two pucks may be supplied with the system 30, the insertion of both pucks is generally avoided as this would lock both ball and socket pivot points in place resulting in the suspension system 34 transmitting an undesirable amount of torque at the suspension point when the pendulum bob 32 is struck. In addition, by avoiding a fixed axis suspension system that would result if both pucks were installed, there is always a relief point for movement of the pendulum bob 32. However, it will be appreciated that both pucks may be installed to lock the upper and lower ball and socket assemblies in certain low impact scenarios avoiding significant push-pull activities, such as merely spinning the pendulum bob 32, or dual puck insertion may be useful in locking the suspension system for transport purposes. Rotation of the pendulum bob 32 is not impacted by the puck insertion so that the pendulum bob may still be spun to raise or lower relative to the overhead support surface or ground surface.

Exemplary Materials: The suspension system 32 components, basket 40, and top plate 44 are preferably constructed of steel, steel alloy, or other suitable metal material constructed to carry such weight and handle pivoting (swinging) motion as well as spinning motion, although ball and socket assembly may be manufactured from a rigid plastic material as well that provide a relatively frictionless pivotable joint. The pucks may also be made of a hard rubber or plastic material. The compression sleeve is constructed of a pliable plastic material or fabric based material. The difference in travel between a fully retracted suspension system 34 to a fully extended suspension system is approximately nine inches, although this is not meant to be limiting. In its entirety, the entire suspension system (extended) and pendulum bob 32 measure approximately six feet two inches long (height) while measuring five feet, ten inches when the suspension system is fully retracted.

The outer shell 42 is preferably constructed of a self-skinning polyurethane foam pad. A useful exemplary size of the outer shell 42 has been found to incorporate wide panels 74*a-e* that are three feet, nine inches in height at the curve and twelve inches wide while the narrow panels 76*a-e* are the same height but approximately four inches wide. These heights and widths are not meant to be limiting in any manner. It will be appreciated that the wider panels facilitate a more stabilizing contact surface (easier to contact during movement of the pendulum bob and/or restore stability to the moving pendulum bob) while the narrower panels facilitate a more destabilizing contact surface (harder to contact during movement of the pendulum bob and/or contribute additional instability to the moving pendulum bob). In other words, more focus and hand-eye coordination is needed to push, or in some cases, strike the narrower panels which makes the user more likely to move the pendulum bob toward a more unstable position or motion when aiming for the narrower panels versus the wider panels. The outer shell diameter is approximately one foot, eleven inches at the top and one foot, five inches at the bottom presenting the inward taper from top to bottom. The anchor straps are preferably constructed of a woven webbing such as nylon. A preferred weight range for the pendulum bob 32 is approximately 120-150 pounds, although this is not meant to be limiting and the weight easily be varied to suit the user's needs.

Exemplary methods of manufacturing: The metallic suspension system components and the steel core basket may be machined, pressed, rolled, stamped, die cut, cast, CnC machined, or constructed from other suitable manufacturing methods. The components may be tapped, drilled, or punched to provide the fastener apertures and throughbores. The nylon anchor straps may be woven using conventional manufacturing techniques. The plastic compression sleeve may be injection molded, blow molded, 3D printed, cast, or other suitable plastic manufacturing technique. The outer shell is preferably sprayed or poured into a mold or form and then allowed to cure to final shape. As discussed above, the foam is preferably self-skinning so no exterior slip cover is needed, although this is not meant to be limiting.

It will be appreciated that many components in the pendulum bob 32 and/or suspension system 34 may be constructed of multiple or unitary pieces. For example, the socket and associated support bracket may be constructed of a single piece or multiple pieces. Other single or multiple piece components will occur to one of ordinary skill in the art.

Use of at least one embodiment of the Variable Stroke Fitness and Exercise System: Referring initially to FIGS. 1 and 9-11, the first task is securing the suspension system 34 to an overhead support structure 36. To accomplish this, the upper support plate 100 is first fastened to the overhead support structure 36 using suitable fasteners such as bolts or other suitable fastener passing through the slotted wings 102*a*, 102*b* and into the overhead support structure. The slotted wings 102*a*, 102*b* allow for the upper support plate 100 to be shifted along the overhead support and positioned to a preferred location prior to fastening the bolts and readily accommodate different joist widths. As one example, the upper support plate is secured to one or more ceiling joists. In another example, the upper support plate 100 allows for a ratchet strap type of securement such as hanging from a tree branch or other support structure that doesn't accommodate bolt or other similar fasteners. The upper socket 106 is secured to the upper support plate 100 using the bolt set 104. Alternatively, the upper socket may be coupled to the upper support plate prior to attaching the upper support plate to the overhead support.

To assemble the rest of the suspension system 34, the upper support rod 126 is inserted through the lower end 140 of the extension and retraction sleeve 130 until a portion of upper support rod passes through the opposing bullet nosed end 134 of the extension and retraction sleeve. The bottom threaded section 128 of the upper support rod 126 is then screwed into the internal threaded section 136 within the bullet nosed end 134 of the extension and retraction sleeve 130 leaving an exposed threaded stem 124 protruding from the extension and retraction sleeve. The exposed threaded end 124 is then threaded into the receptacle 122 of the upper ball member 120. The elongated lower support rod 150 is then partially threaded into the internally threaded nut 142 exposing the top end of the lower support rod. The washer 146 is then secured to the exposed top end of the elongated lower support rod 150. The internally threaded nut 142 is then slipped inside the lower end 140 of the extension and retraction sleeve 130 and secured in place with the snap ring 144. The compression sleeve 182 is slip fit over the lower support rod and partially over the exterior surface of the cylindrical section 132 of the extension and retraction sleeve 130. The threaded lower end 154 of the lower support rod 150 is threaded into the receptacle 158 of the lower ball member 160.

The locking collar 185 (FIG. 11) is disposed to capture the lower end 183 of the compression sleeve 182 about the free spinning flange 156 and secure the lower end 183 to the lower support rod 150. This locking collar secures the lower end 183 of the compression sleeve about the free spinning flange 156 that allows the lower support rod 150 to spin without twisting up the compression sleeve during retraction or extension. The upper end 187 of the compression sleeve may be secured to the exterior surface of the extension and retraction sleeve 130 using a zip tie or other suitable fastener. In such arrangement, both the lower end 183 and upper end 187 of the compression sleeve are fixed in position relative to the lower support rod and extension and retraction sleeve 130 but may compress or extend as the lower support rod threads through the extension and retraction sleeve.

At this point, the assembled suspension system 34, minus the lower socket 166, may be hung from the upper socket by slipping the stem or narrow neck region of the upper support rod 126 through the opening 108 between the opposing arms 110*a*, 110*b* of the upper socket hook and nesting the rounded surface 118 against the complementary rounded surface 114 of the upper socket 106. This leaves the lower ball member 160 hanging free in a vertically oriented position.

With most of the suspension system 34 in place, suspending the pendulum bob 32 is the next task. As shown in FIG. 7, the outer shell 42 may be slip fit over the steel core basket 40 of pendulum bob 32. The top plate 44 may then be secured to the flange 56 of the basket 40 using the bolt set 92 or another suitable fastener. The lower socket 166 is then secured to the upper surface 177 of the pendulum bob attaching bracket 176 using the bolt set 178. The pendulum bob attaching bracket 176 (FIG. 9) is then affixed to the top plate 44 of the basket/outer shell assembly using a set of suitable fasteners.

With the lower socket 166 secured to the top plate 44 of the basket/outer shell assembly, the user may then hoist (alone or with assistance) the pendulum bob 32 into position with the lower socket 166 proximate the lower ball member 160. The pick points (exposed anchor straps) may also be used to assist the user(s) in hoisting the pendulum bob into position. The narrow region on the lower end 152 of the lower support rod 150 with the lower ball 160 suspended therefrom may be slipped through the opening 168 between the opposing hook arms 170*a*, 170*b* to nest the rounded surface 160 of the lower ball 162 against the interior rounded surface 174 of the lower socket 166.

Referring now to FIGS. 1-5, at this point, the pendulum bob 32 is suspended from the overhead support structure 36 through the suspension system 34 in a plumb position (equilibrium position) relative to the floor 38. In addition, the lower flat surface 105 of the upper support bracket 100 faces the upper flat surface 120 of the upper ball 116 and the upper flat surface 177 of the pendulum bob attachment bracket 176 faces the flat surface 164 of the lower ball 162. The upper puck 184 and the lower puck 186 have not been inserted into the suspension system 34 at this point.

Referring now to FIGS. 6B and 7, the user may also extract the free ends of one or more selected anchor straps such as 86*a-c* or 88, for example, by pulling the selected strap(s) through the slits or openings in the outer shell 42 on the lateral sidewall panels 74*a-e* and/or 76*a-e* and the bottom recess 78.

Figure 12:
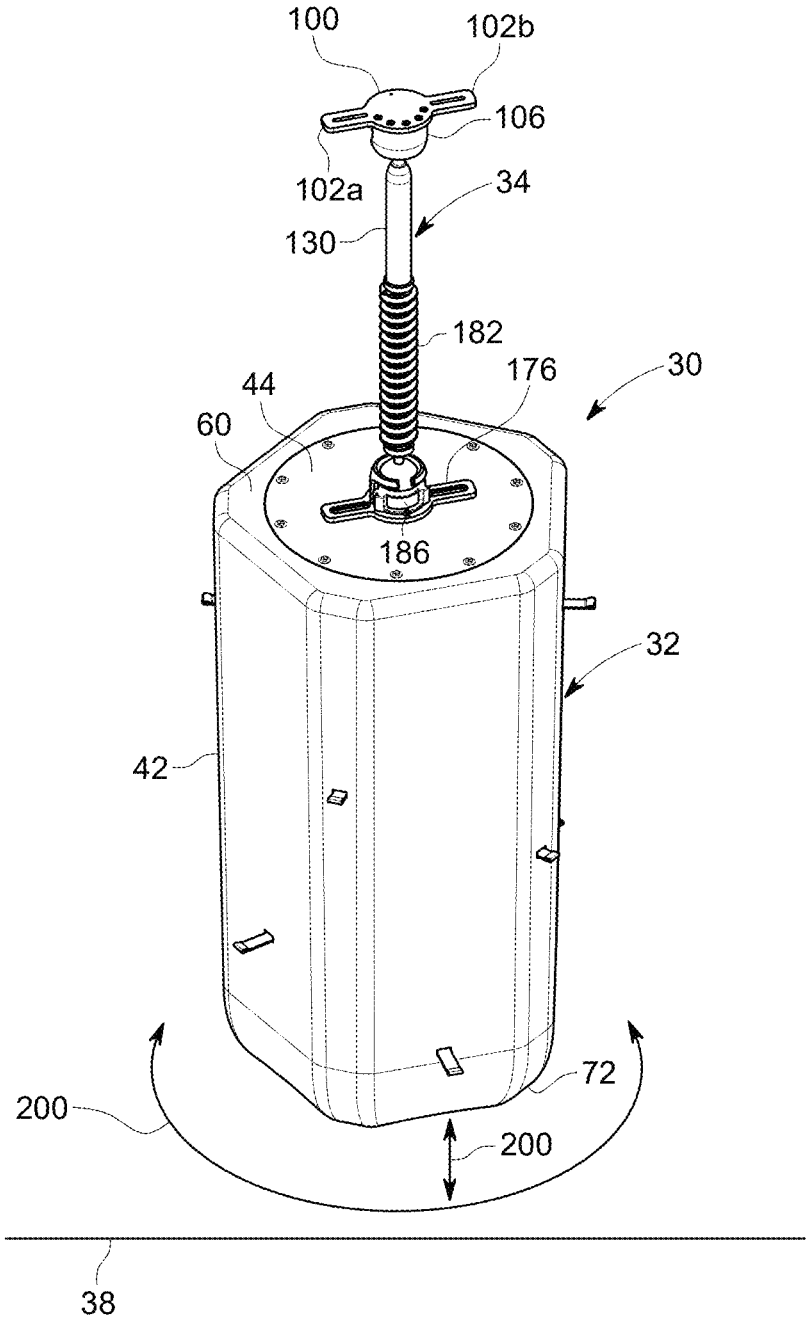
FIG. 12 is a similar view to FIG. 1 with the pendulum bob in an extended position and depicting a rotational direction arrow about a vertical axis plumb line and without the overhead support structure.

Changing Height: Turning now to FIGS. 1 and 11-12, the user may vary the stroke of the pendulum bob 32 by changing the height of the pendulum bob 32 relative to the floor 38 or ground surface as well as the height differential between the pendulum bob and the overhead support structure 36. As shown in FIG. 12, the pendulum bob 32 may be rotated about a plumb line 200 as indicated by rotational arrow 202. As shown in FIG. 12, the pendulum bob is shown in a fully extended position. To change the height of the pendulum bob 32, the user may simply spin the pendulum bob 32 in a first direction by interacting with one or more side panels 74*a-e* and/or 76*a-e* (FIGS. 6A-6B). If the user spins the pendulum bob in a first direction, the lower support rod 150 (FIG. 9) will thread further up into the extension and retraction sleeve 130 compressing the compression sleeve 182 accordingly as shown in FIG. 11. This would raise the bottom 72 of the pendulum bob further off the ground surface while also raising the top end 60 of the pendulum bob closer to the overhead support structure 36 (FIG. 1). On the other hand, if the user spins the pendulum bob in the opposite direction along directional arrow 202 after the pendulum is raised from a fully extended position, then the lower support rod 150 will thread further out of the extension and retraction sleeve 130 and expand the compression sleeve 182 accordingly. This rotational effort would lower the bottom 72 of the pendulum bob 32 toward the ground 38 and also lower the top end 60 of the pendulum bob relative to the overhead support structure 36. It will be appreciated that spinning the pendulum bob 32 may result in the upper and lower sockets 106, 166 being out of alignment with one another. However, this does not impact the use of the pendulum bob as the construction allows for rotation and tilting regardless of the direction that the opening in the sockets face.

Stroke Variation: In addition to varying the height of the pendulum bob 32, the user may also vary the stroke from a single pivot point to a full dual pivot range of motion. Depending on pendulum bob 32 stroke and swing angle range desired, the user may insert the first puck 184 (FIG. 9) into the upper socket 106 and the second puck 186 into the lower socket 166 of the suspension system 32 to lock the entire pendulum bob in a fixed vertical or plumb orientation. This may be useful when the user desires to interact with the pendulum bob 32 in a fixed location such as when desiring to strike an immobile target at a known location. In this instance, the pendulum bob 32 has no stroke, defined as motion away from the plumb line 200 (FIG. 12). In such configuration, the centerline of the suspension system and the centerline of the pendulum bob will align with the plumb line or equilibrium line 200 (FIG. 12).

Figure 13:
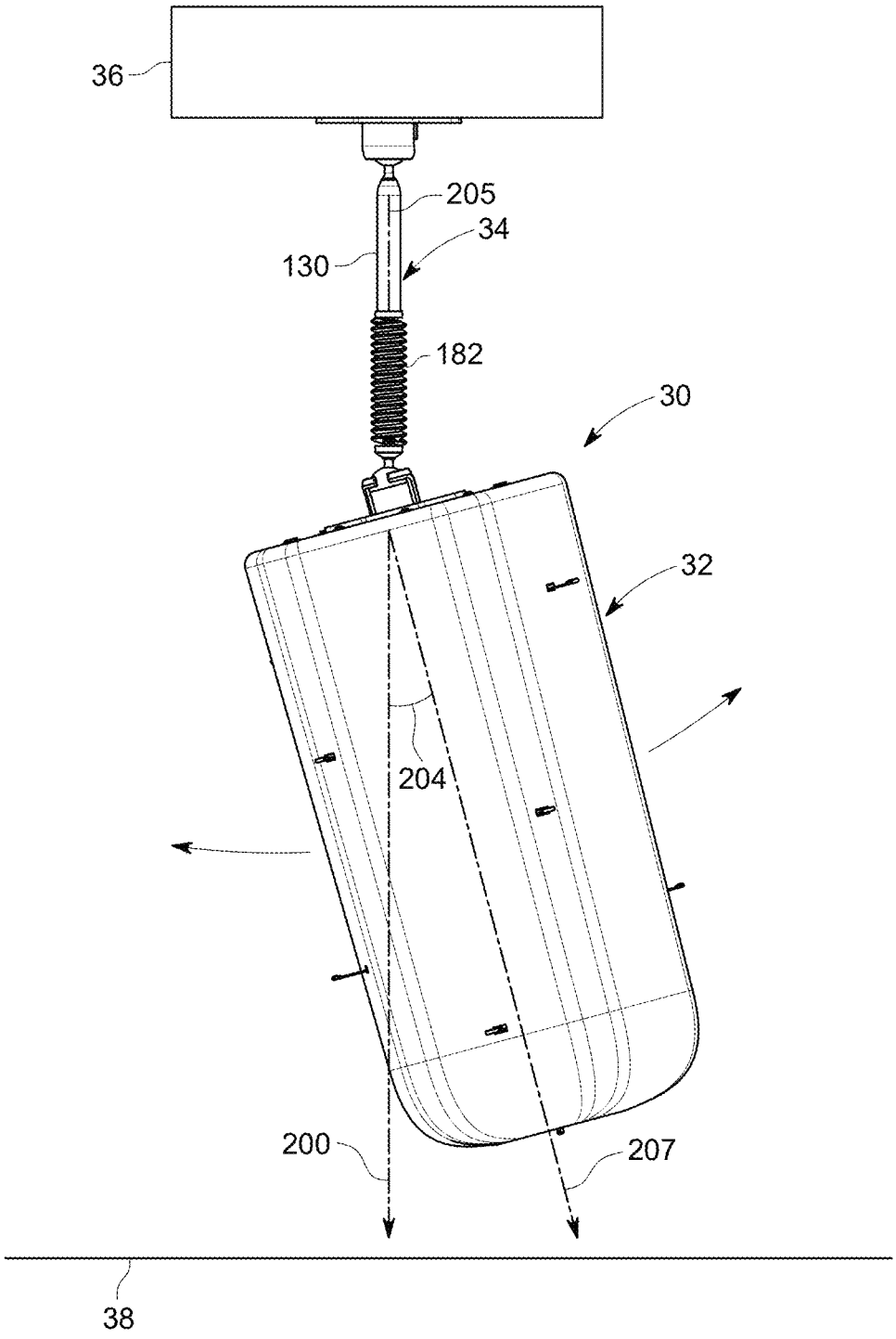
FIG. 13 is a front view of the variable stroke fitness and therapy system with the upper puck inserted fixing the upper ball and socket joint in place and the lower puck removed with the pendulum bob tilted at an angle to the vertical plumb line.

Alternatively, the user may place one of the interchangeable pucks 184, 186 (FIGS. 9-11) into the opening between the upper surface 103 of the upper bracket 100 and the flat surface 120 of the upper ball 116 within the upper socket 106 to lock the upper ball and socket assembly. In this instance, the pendulum remains free to swing about the lower socket 166 but remains fixed at the upper socket 106 as shown, for example, in FIG. 13. Such configuration maintain the upper portion of the suspension system 34 along the plumb line 200 while allowing the pendulum to swing back and forth across the plumb line 200 through an angle 204, also referred to as the displacement angle, measured between the plumb line and the centerline of the pendulum bob 207. It will be appreciated that the complete swing angle is double the swing angle 204 represented in FIG. 13 as the pendulum may swing back and forth across the plumb line. This upper puck locking configuration reduces the overall swing radius of the pendulum bob 32 compared to omitting both pucks but more freedom of movement compared to using both pucks. Such upper locking mode may be useful in a smaller space, for example, where the swing of the pendulum needs to be more limited due to spacing requirements, or alternatively, provide a different swing radius or arc to vary the exercise or therapy motion. In this example, the centerline 205 of the suspension system 34 does not align with the centerline 207 of the pendulum bob 32 when the pendulum is out of the equilibrium position 200.

Figure 14:
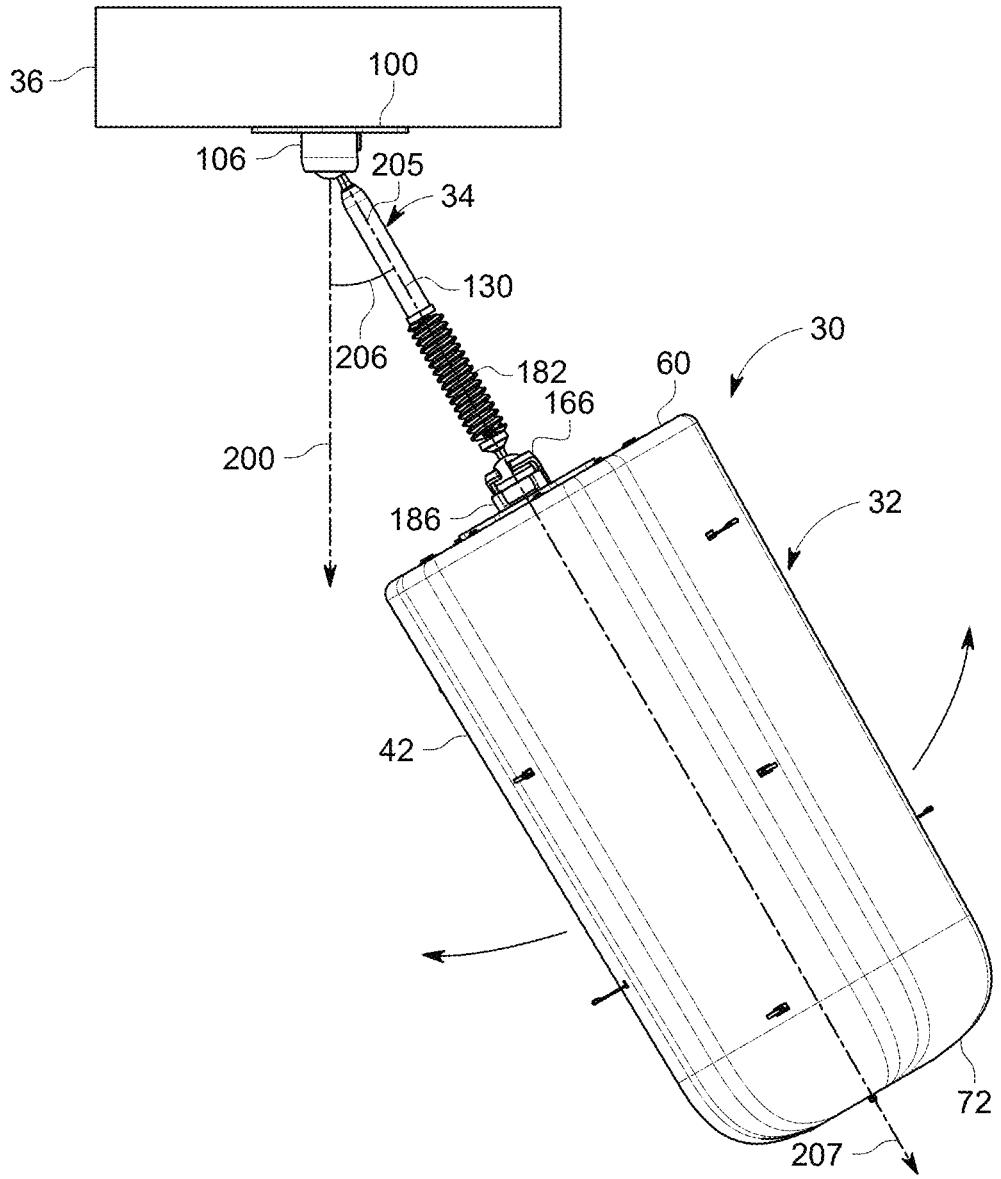
FIG. 14 is a front view of the variable stroke fitness and therapy system with the upper puck removed and the lower puck inserted with the pendulum bob tilted at an angle to the vertical plumb line from the upper ball and socket joint.

As another alternative as shown in FIG. 14, the user may place a single puck 184 or 186 into the opening between the upper surface 177 of the lower bracket 176 and the flat surface 164 of the lower ball 162 within the lower socket 166 to lock the upper ball and socket assembly in place resulting in a larger potential swing radius 206 measured from the plumb line 200 relative to the centerline 207 of the pendulum bob 32 versus the swing radius 204 resulting from locking the upper ball and socket assembly. It will be appreciated that only half of the complete swing (or sweep) angle 206 is represented in FIG. 14. In this example, the centerline 205 of the suspension system aligns with the centerline 207 of the pendulum bob 32 throughout the swing. As will be appreciated, the insertion of the upper puck as in FIG. 13 versus the insertion of the lower puck in FIG. 14, significantly transfers the load between the pivot points offering an increased pendulum bob resistance scenario and a decreased pendulum bob resistance scenario relative to puck placement.

Figure 15:
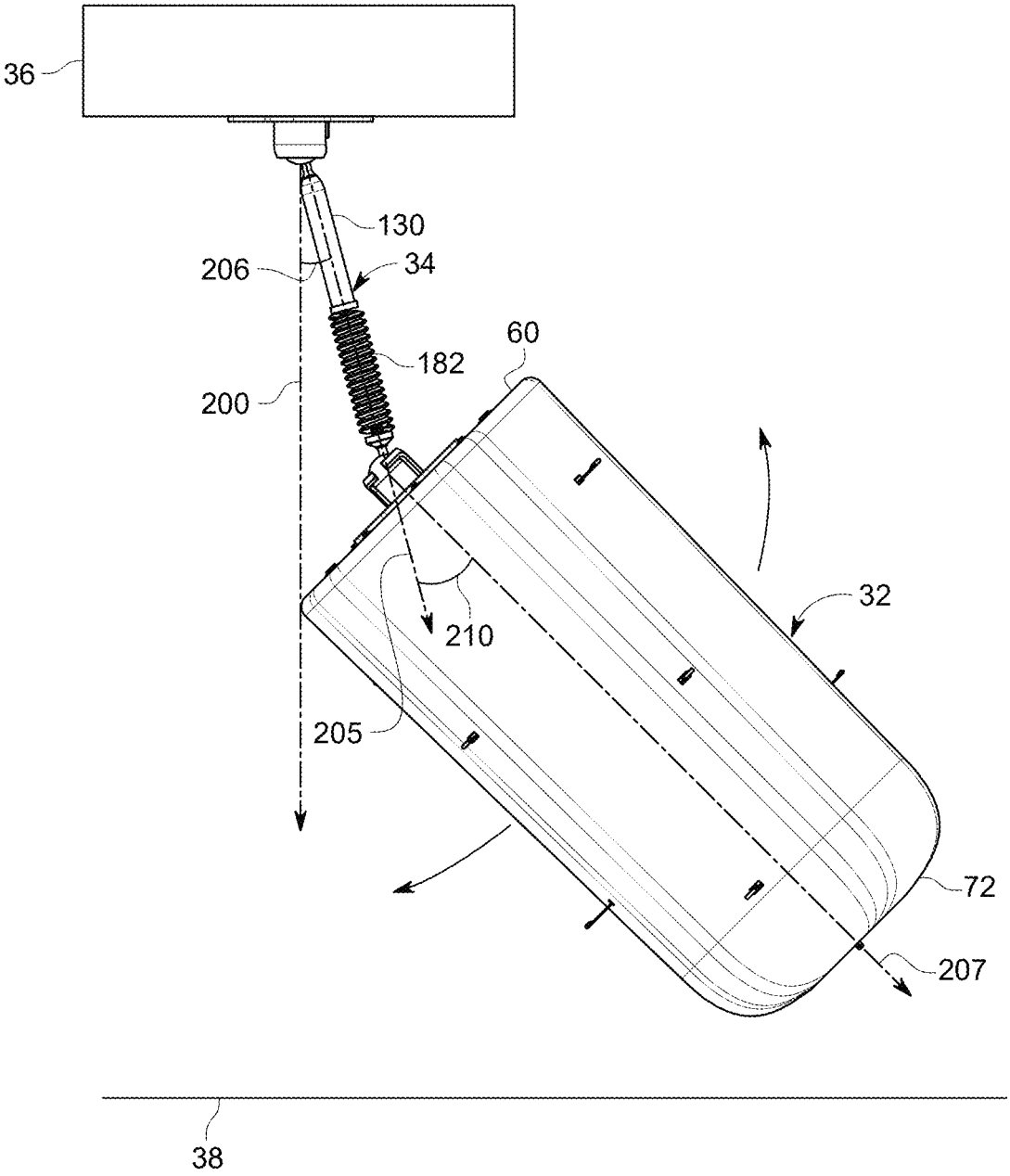
FIG. 15 is a front view of the variable stroke fitness and therapy system with both locking pucks removed and depicting the pendulum bob tilted at both the top and bottom ball and socket locations.

As yet another alternative as best shown in FIG. 15, the user may decline to employ either puck 184, 186 in the suspension system 34 and leave the pendulum bob 32 free to tilt about both the upper and lower ball and socket assemblies for a dual pivoting motion about both the upper ball and socket pivot point and the lower ball and socket pivot point. Such variation may result in a more whip-like motion of the pendulum bob 32. More specifically, the absence of the upper puck 184 allows the pendulum bob 32 a freedom of movement to swing about the plumb line 200 through an angle 206 measured from the plumb line 200 to the centerline 205 of the suspension system 34 as with the example in FIG. 14. In addition, the absence of the lower puck 186 allows for an additional freedom of movement through a swing arc 210 measured from the centerline 205 of the suspension system 34 to centerline of the pendulum bob 207 providing for an upper and lower pivot point about the upper ball and socket assembly and lower ball and socket assembly, respectively.

As described above, the insertion of both pucks 184, 186 into the suspension system 34 results in a fixed position pendulum bob 32 maintained at the equilibrium position or plumb line. On the other hand, the insertion of a single puck 184 or 186 results in a single pivot point, occurring at the upper or lower ball and socket assembly depending on where the puck is inserted. In addition, the absence of both pucks from the suspension system 34 results in a dual pivot point system wherein the pendulum bob 32 may swing through both an upper pivot point and a lower pivot point resulting in more instability and a greater challenge to interacting with the pendulum bob 32.

Examples Of Exercise And Fitness Routines Using The Variable Stroke Exercise And Fitness System: Depending on how the user wishes to interact with the pendulum bob 32, the user may interact directly with the pendulum bob or, alternatively, add one or more accessories to interact with the pendulum bob as will be described below.

Figure 16:
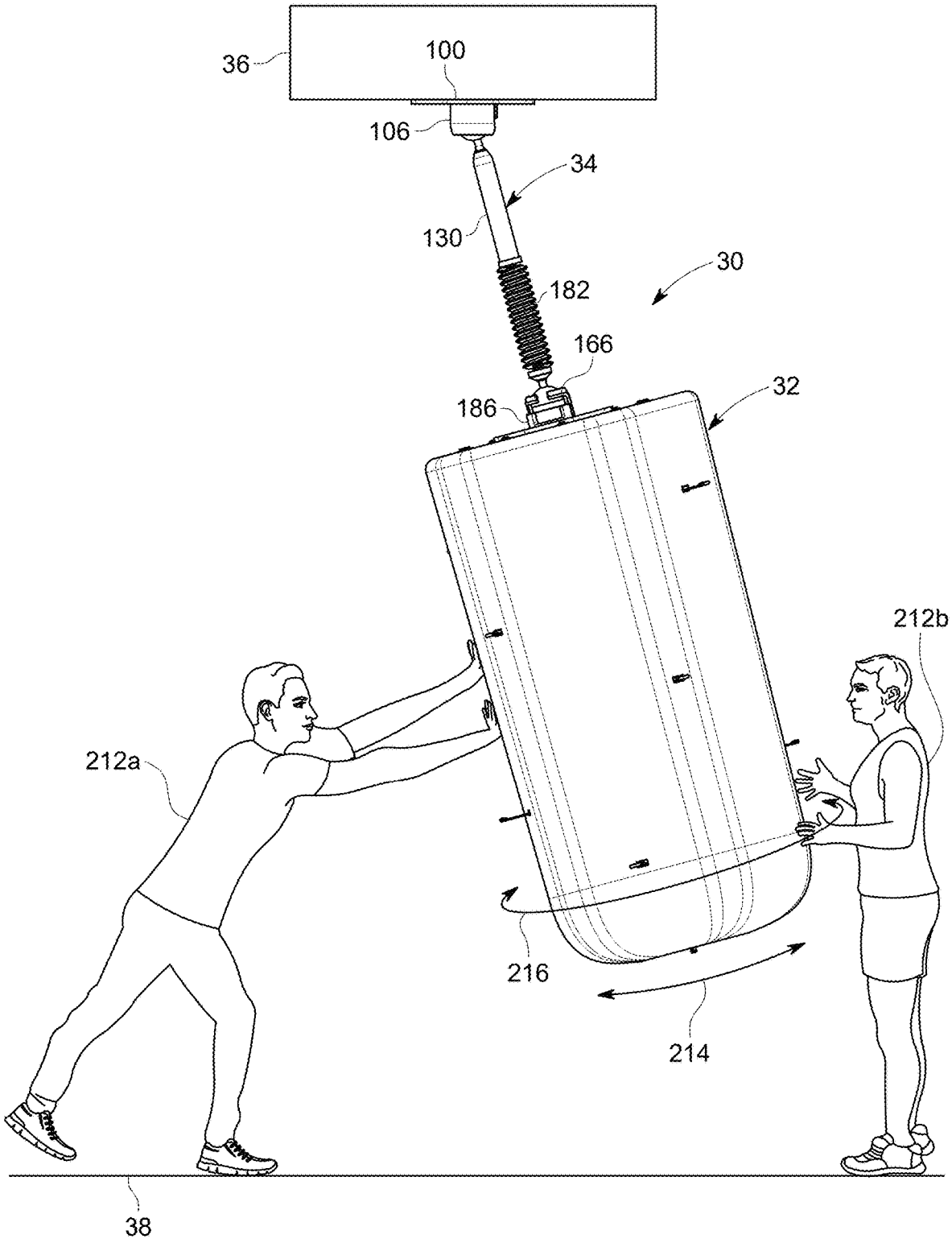
FIG. 16 is a front view of the variable stroke fitness and therapy system with a person pushing the pendulum bob toward a receiving person on the opposing side.

Turning now to FIG. 16, a pair of users 212*a*, 212*b* are situated on opposing sides of the pendulum bob 32 wherein each user may push and swing the pendulum bob toward the other user, who then catches or stops the pendulum bob and then either releases the pendulum bob allowing gravity to control the swing and/or adds an extra pushing motion to the pendulum bob back toward the first user indicated by the bi-directional swing angle 214. In addition to or in lieu of, as shown by the bi-directional rotational arrow 216, each user may spin the pendulum bob 32 to raise and/or lower the pendulum bob relative to the ground adding an additional challenge to the opposing user to stabilize the pendulum bob 32. Thus, it will be appreciated that the opposing user will need to react to either a spinning motion, a swinging motion, or a combination of a swinging and spinning motion adding a large variety of exercise and therapy motions.

Figure 17:
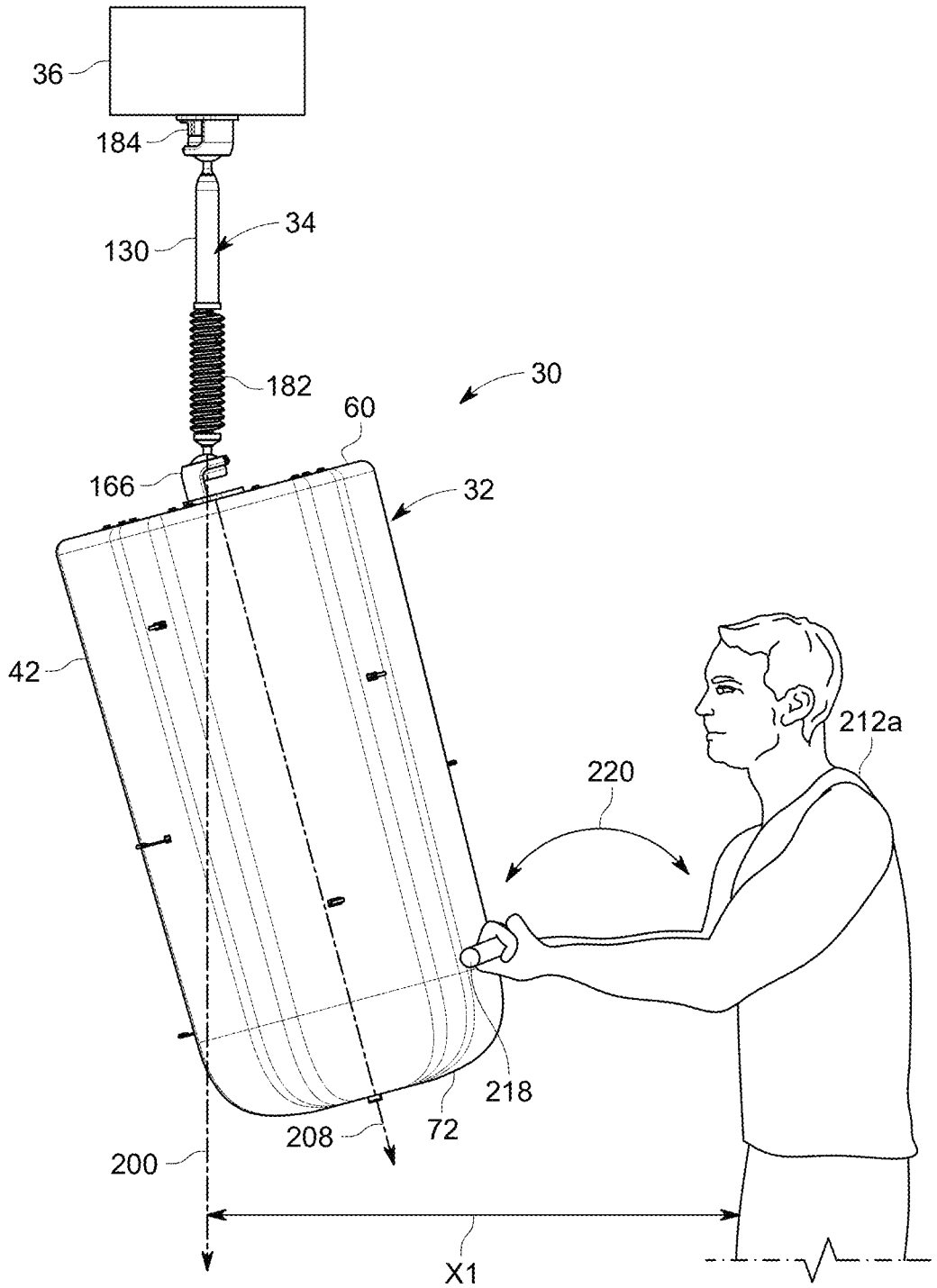
FIG. 17 is a left side view of the variable stroke fitness and therapy system with upper locking puck installed and with an accessory bar connected to a tilted pendulum bob through a lower position anchor strap with a person curling the accessory bar and the pendulum bob tilted at an angle.

Referring now to FIG. 17, a user 212*a* is shown using with an elongated accessory bar 218 slipped through an opening in the outer extremity of a lower position anchor strap 86*c* (FIGS. 1 and 7) connected to a tilted pendulum bob 32. In this example, the upper puck 184 is installed while the lower puck 186 has been removed from the suspension system 34. The user is positioned at a distance X1 from the plumb line 200. In such position, the user may perform a conventional curling motion as indicated by bi-directional motion arrow 220 using the accessory bar and allowing the pendulum bob to raise and lower allowing the user to focus on the desired muscle set. It will be appreciated that the pendulum mass 32 will seek to return to a position of equilibrium along the plumb line 200 (FIG. 13) and generally work both against the user and with the user depending on the sequence of the curling motion.

Figure 18:
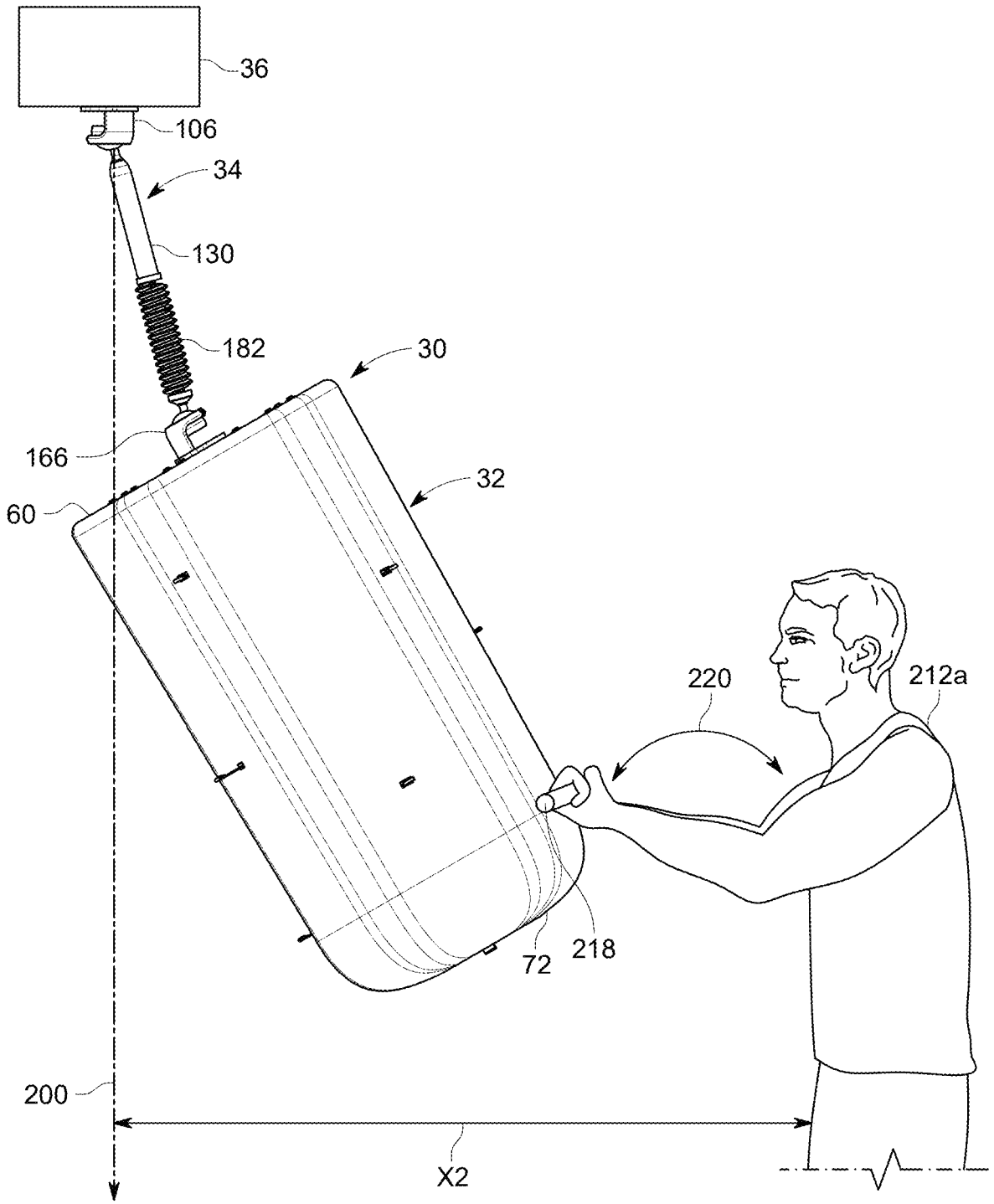
FIG. 18 is a similar view to FIG. 17 with the person located further from the plumb line with no locking pucks installed in the multi-pivot suspension system.

Referring now to FIG. 18 in which the user 212*a* is undertaking a similar curling exercise as in FIG. 17 as indicated by the bi-directional arrow 220. In this example, however, the user is disposed further away from the pendulum bob 32 at a distance of X2 from the plumb line 200 and both pucks 184, 186 have been removed from the suspension system 34 resulting in a greater stroke angle resulting in a different resistance to the overall motion. It will be appreciated that by merely changing their own distance from the plumb line 200, the user experiences an entirely different set of resistance and stability challenges.

Figure 19:
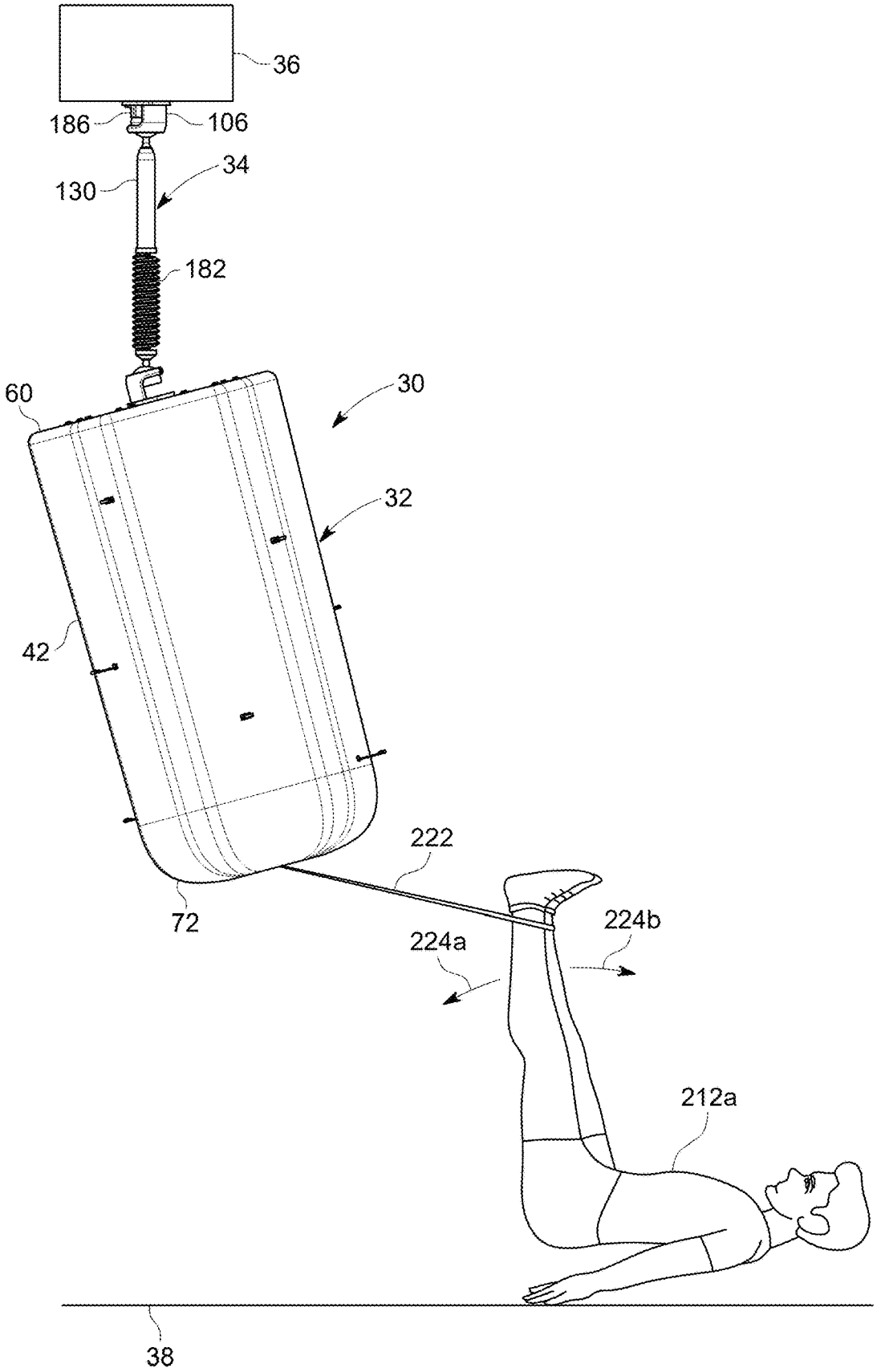
FIG. 19 is a left side view of the variable stroke fitness and therapy system depicting a person lying on their back on the floor with their feet secured to an accessory strap passing through the bottom anchor point of the pendulum bob.

As shown in FIG. 19, the user 212*a* may lay on their back on the floor 38 with their feet secured to an accessory strap 222 passing through the bottom anchor point 88 (FIG. 6B) of the pendulum bob 32. By raising and lowering their legs along the direction arrows 224*a*, 224*b* or rotating their legs to the left and right, and/or separating and closing their legs if using a dual ended strap, the user may swing the pendulum bob through a desired swing angle encountering resistance invoked by the pendulum bob.

Figure 20:
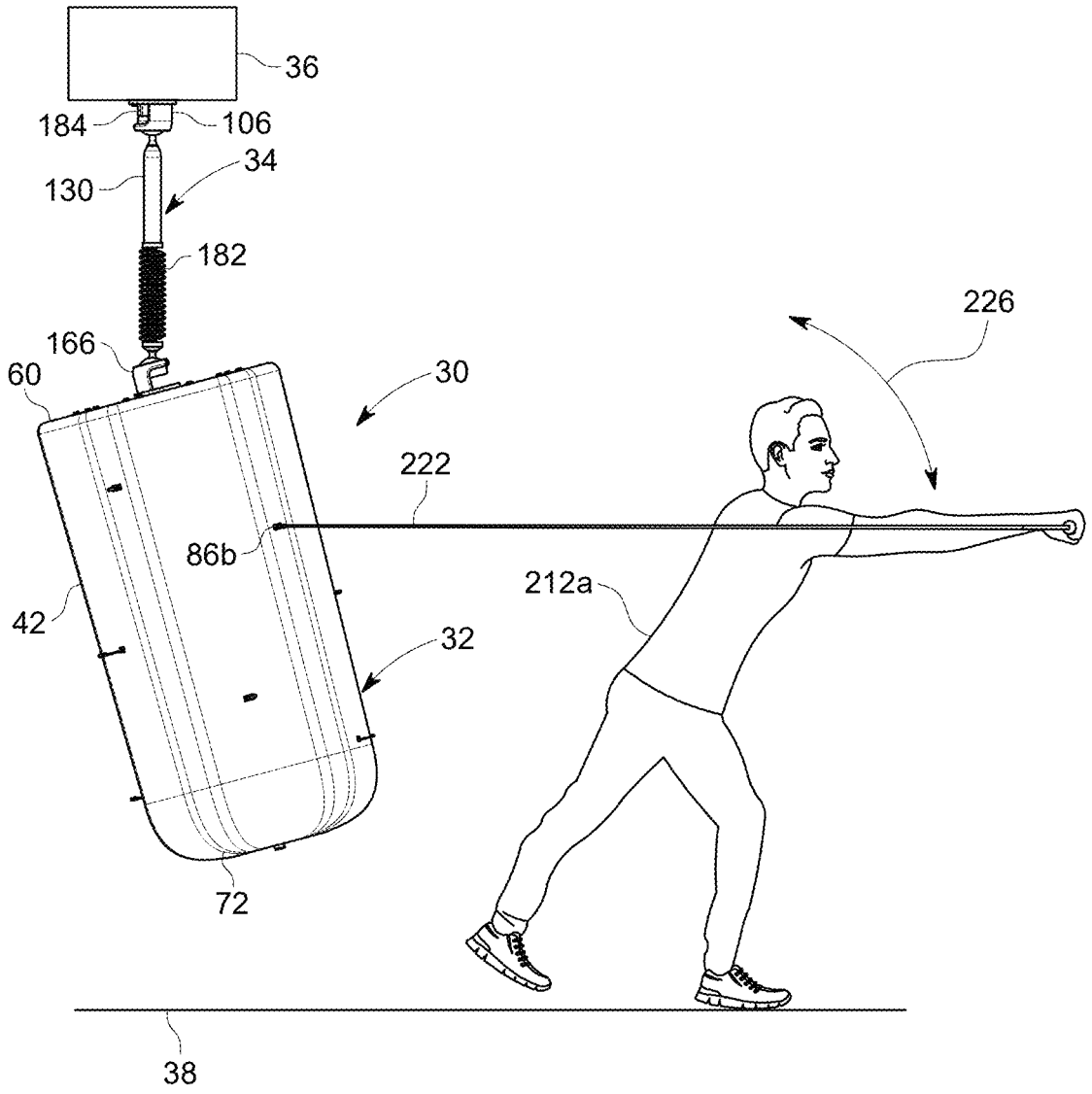
FIG. 20 is a left side view of the variable stroke fitness and therapy system with a person facing away from pendulum bob with their arms extended from shoulder height holding the ends of a strap secured to an intermediate anchor point.

Another motion example is depicted in FIG. 20. In this instance, the user 212*a* is facing away from the pendulum bob 32 with their arms straight out about shoulder height holding the ends of an accessory strap 222 secured to an intermediate anchor point 86*b*. In this position, the user has completed an overhead pulldown motion and may now bend their arms about the elbows following the bi-directional arrow 226.

Figure 21:
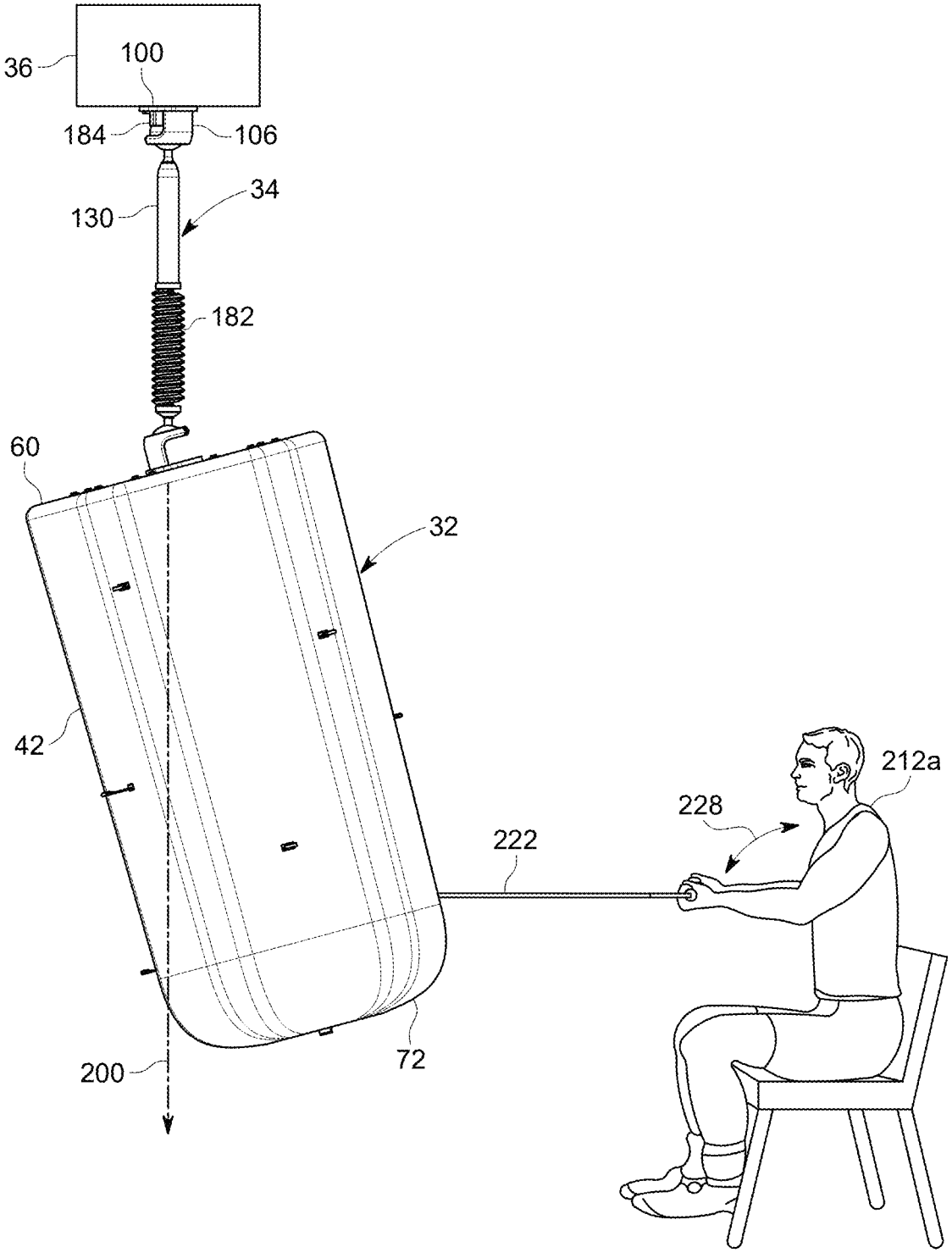
FIG. 21 is a left side view of the variable stroke fitness and therapy system depicting a person in a chair with their hands attached to a strap passing through a lower anchor point and pendulum bob tilted toward them.

In addition to the standing and ground based exercises as exemplified above, a user 212*a* may perform a variety of routines from a seated position as, for example, shown in FIG. 21. In this example, the user is seated in a chair with their hands attached to an accessory strap passing through a lower anchor point with the pendulum bob 32 tilted toward them. The user may perform a curling motion along bi-directional arrow 228 to swing the pendulum bob 32 back and forth dislodging the pendulum bob away from the equilibrium position indicated by the plumb line 200 and allowing the pendulum bob to return toward the equilibrium position. Such positioning may be useful for elderly, wheelchair bound, or other partially motion restricted users, merely as yet another motion variation, or useful in areas with limited space.

Turning now to FIGS. 22-26, an alternative multi-pivot suspension system, generally designated 234, is depicted. As the alternative multi-pivot suspension system 234 incorporates many of the same or similar elements as the prior suspension system 34, like components may be like numbered, although this is not meant to be limiting in any manner. In general, this embodiment of an alternative multi-pivot suspension system 234 replaces the locking and unlocking mechanisms in the form of the upper and lower puck inserts 184, 186, as for example shown in FIG. 11, with an alternative ball and socket locking system while maintaining the same multi-pivot and length changing functionality. Like the prior suspension system 34, the alternative multi-pivot suspension system 234 incorporates an upper portion 235 and a lower portion 237 that may be assembled together to form a complete multi-pivot suspension system that may be used to suspend the pendulum bob 32 from an overhead support structure 36 (FIG. 1).

With continued reference to FIGS. 22-24 and 26, the upper portion 235 of the multi-pivot suspension system 234 includes a dog-boned shaped mounting plate 300 with a number of options for mounting to a support structure 36 (FIG. 1). More specifically, the mounting plate includes an outermost set of throughbores 302 to either side of the center of the mounting plate for securing the mounting plate to a sixteen inch joist span, a first intermediate set of throughbores 304 to either side of the center of the mounting plate for securing the mounting plate to a twelve inch joint span, and a second pair of intermediate opposing throughbores 306 to either side of the center of the mounting plate for mounting to a support structure that incorporates tubing or piping. The mounting plate 300 further includes a set of spaced apart narrowed regions 308*a*, 308*b* giving the mounting plate the roughly dog-bone shape. The narrowed regions accommodate the use of one or more straps to secure the mounting plate as another alternative mounting solution. It will be appreciated that these throughbore sets and strap region options facilitate securing the mounting plate to a variety of overhead support structures 36.

Figure 26:
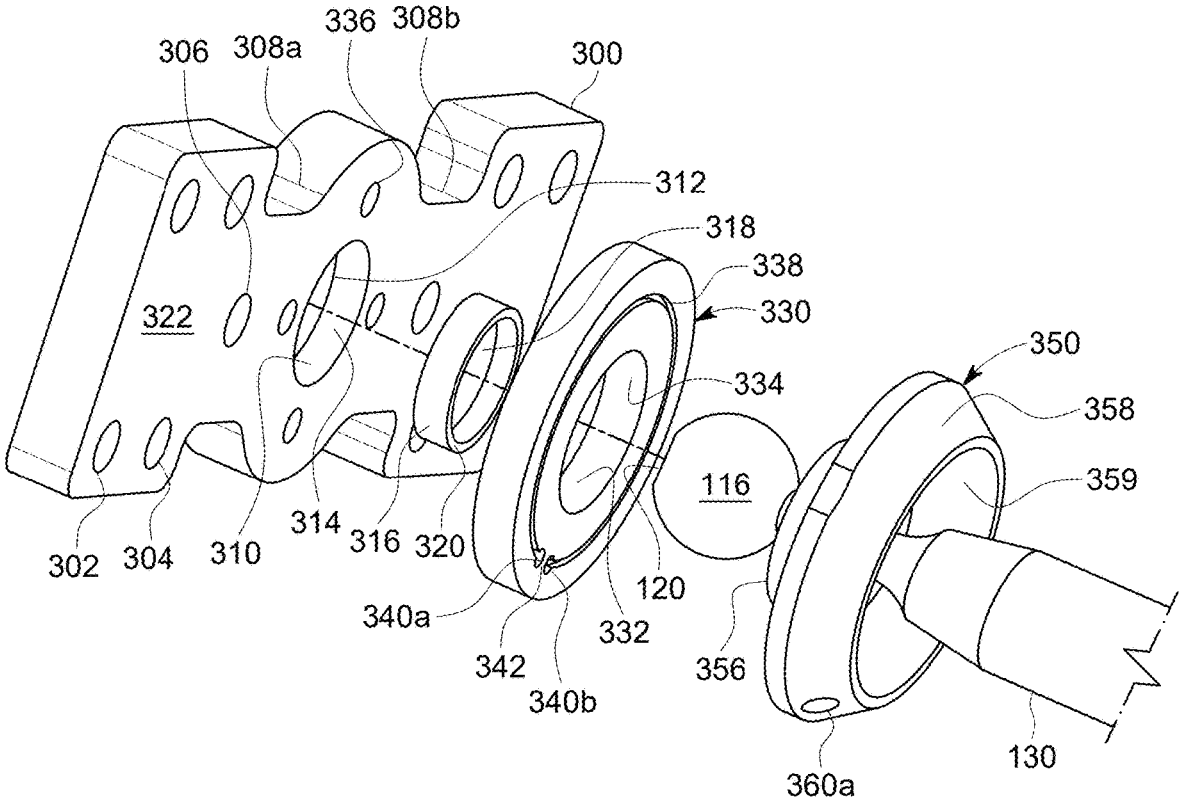
FIG. 26 is a tilted exploded view of the upper portion of the multi-pivot suspension system of FIG. 22.

With continued reference to FIG. 26, centrally disposed within the mounting plate 300 is a central recess 310 with a flat uppermost surface 312 and cylindrical sidewall 314 for receiving an upper reinforcement cup or insert 316 with a flat upper surface 318 and cylindrical sidewall 320 extending therefrom. The cup 316 has dimensions that closely conform to the dimensions of the central recess and is nested therein and held in place by a friction fit or other suitable fastening method. The outermost extent of the cylindrical sidewall 320 of the cup 316 is flush with the lowermost surface 322 of the mounting plate when secured within the recess 310. In this exemplary embodiment, the mounting plate may be constructed from an aluminum block. In contrast, the reinforcement cup is preferably constructed of stainless steel to provide an extra layer of protection against wear and tear on the mounting block thus reducing the likelihood of slop in the joint as well as maintaining the integrity of the joint. The reinforcement cup 316 also cooperates with other elements of the upper portion 235 of the multi-pivot suspension system 234 to create a locked or unlocked pivot point as described below.

Turning to FIGS. 22-24 and 26, the upper portion 235 of the multi-pivot suspension system 234 further includes a first component of a locking mechanism or female coupler 330. The female coupler is generally disc-shaped with a central recess 332 having an internal threaded sidewall 334 (FIG. 26). The upper surface of the female coupler is secured by a set of fasteners passing through a set of four spaced apart throughbores 336 surrounding the central recess 310 of the mounting plate 300. Such throughbores 336 are preferably countersunk in the top surface of the mounting plate 300. The lowermost surface 338 of the female coupler 330 includes a C-shaped channel 338 that terminates in a pair of spaced apart opposing pin receiving receptacles or nipples 340*a*, 340*b*. The C-shaped channel essentially defines a portion of a helix with the deepest section being formed at the initial engagement nipple 340*a* and the shallowest section defined at the locking engagement nipple 340*b* with a gradually decreasing in depth, smooth contoured surface spanning therebetween. The gap 342 between the nipples 340*a*, 340*b* is relatively narrow resulting in the C-shaped channel circumnavigating almost the entire three hundred sixty degree lower surface 338 of the female coupler 330.

Continuing with FIGS. 22-24 and 26, the upper portion 235 of the multi-pivot suspension system 234 also includes an upper ball 116 (same as in FIGS. 9 and 11) with a flat upper surface 120 that resides at least partially within the central recess 332 of the female coupler 330 and also at least partially travels therethrough to make contact with the cup 316 or move away from the cup 316 during the locking and unlocking processes. Depending on the locking or unlocking status of the upper portion 235, the flat surface 120 of the upper ball 116 abuts the flat surface 318 of the steel cup 316 when the upper joint is locked or is spaced apart when the upper joint is unlocked as will be described below. It will be appreciated that the diameter of the central recess 332 is slightly larger than the diameter of the upper ball 116 so the ball may slip back and forth through the central recess 332 to make contact with the flat surface 318 of the steel cup 316 or move away from the flat surface 318.

Still referring to FIGS. 22-24 and 26, capturing the upper ball 116 is a second complementary locking mechanism or male coupler 350 (or locking collar). The male coupler 350 includes a central opening 352 projecting therethrough that provides a contoured seat 354 (best seen in FIG. 24) for nesting the upper ball 116. The concave shaped seat 354 closely conforms to the outer curved surface of the upper ball 116 thereby capturing the upper ball while allowing freedom of movement when unlocked. In addition, the seat 354 ensures the upper ball 116 cannot pass completely through the male coupler. Together, the upper ball 116 and male coupler 350 define an upper ball and socket joint. The male coupler includes a hollow externally threaded post 356 that complements the internal threaded region 334 of the female coupler 330. Projecting radially outwardly from the threaded post 356 of the male coupler 350 is a range of motion collar 358 with an interior facing outwardly tapered sidewall 359 that provides a limit on the range of motion on the multi-pivot suspension system 234. A range of fifty-five degrees to one side of the plumb line has been found to provide a sufficient swing arc, although this is not meant to be limiting and the range of motion collar may be altered to narrow or widen the swing arc of the pendulum bob. When the multi-pivot suspension system 234 is fully assembled, the tapered sidewall faces toward the lower portion 237 of the multi-position suspension system 234. The outer surface of the range of motion collar 358 includes a pair of opposing receptacles 360*a*, 360*b* to receive the ends of a pair of handles 362*a*, 362*b*, respectively. The handles, when inserted, are useful in assisting a user or users in hoisting the threaded post 356 of the male coupler 350 into contact with the internal threaded section 334 of the female coupler 330 for securing a pendulum bob 32 coupled to the lower portion 235 of the multi-pivot suspension system 234 from the overhead support structure 36. The handles also facilitate turning the male coupler relative to the female coupler for locking and unlocking the system at the upper pivot point. Projecting from the upper surface of the range of motion collar 358 is a spring loaded, outwardly biased, pin 364 (FIG. 22) constructed to insert into and/or engage the first and second nipples 340*a*, 340*b* and slide through the C-shaped channel 338 in the female coupler 330 as will be explained below.

As with the prior suspension system embodiment 34, the upper portion 235 of the multi-pivot suspension system 234 further includes an extension and retraction sleeve 130 (same as in FIGS. 9 and 11) with a threaded upper end 124 for screwing into a complementary threaded receptacle in the upper ball 116. It will be appreciated that the upper ball 116, threaded upper end 126, and extension and retraction sleeve 130 may be a single assembled or unitary component instead of three separate components. The central opening of the male coupler 350 is wide enough to allow the extension and retraction sleeve 130 to pass through but not the upper ball 116, which nests in the seat 354.

Figure 22:
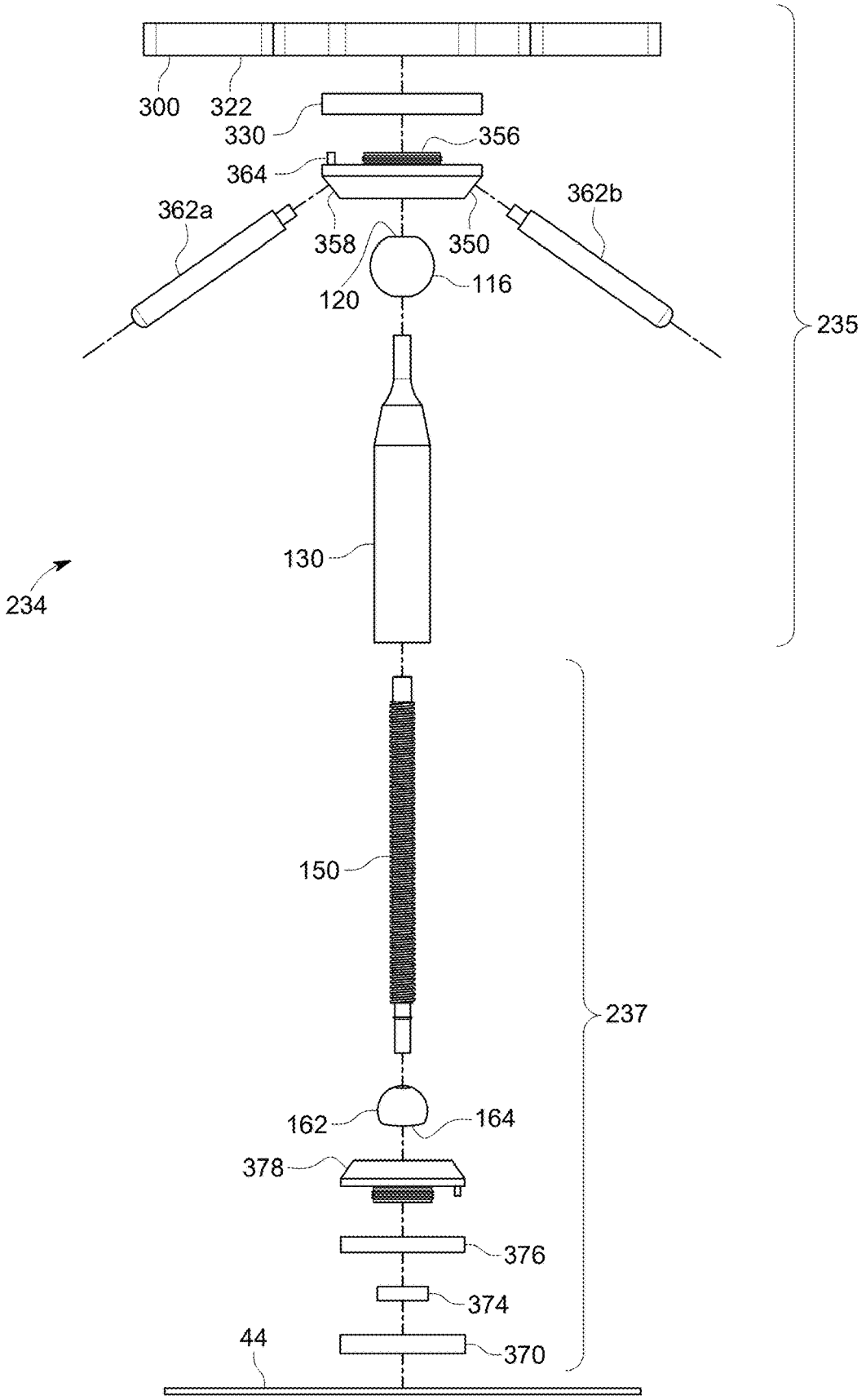
FIG. 22 is an exploded view of an alternative multi-pivot suspension system.
Figure 23:
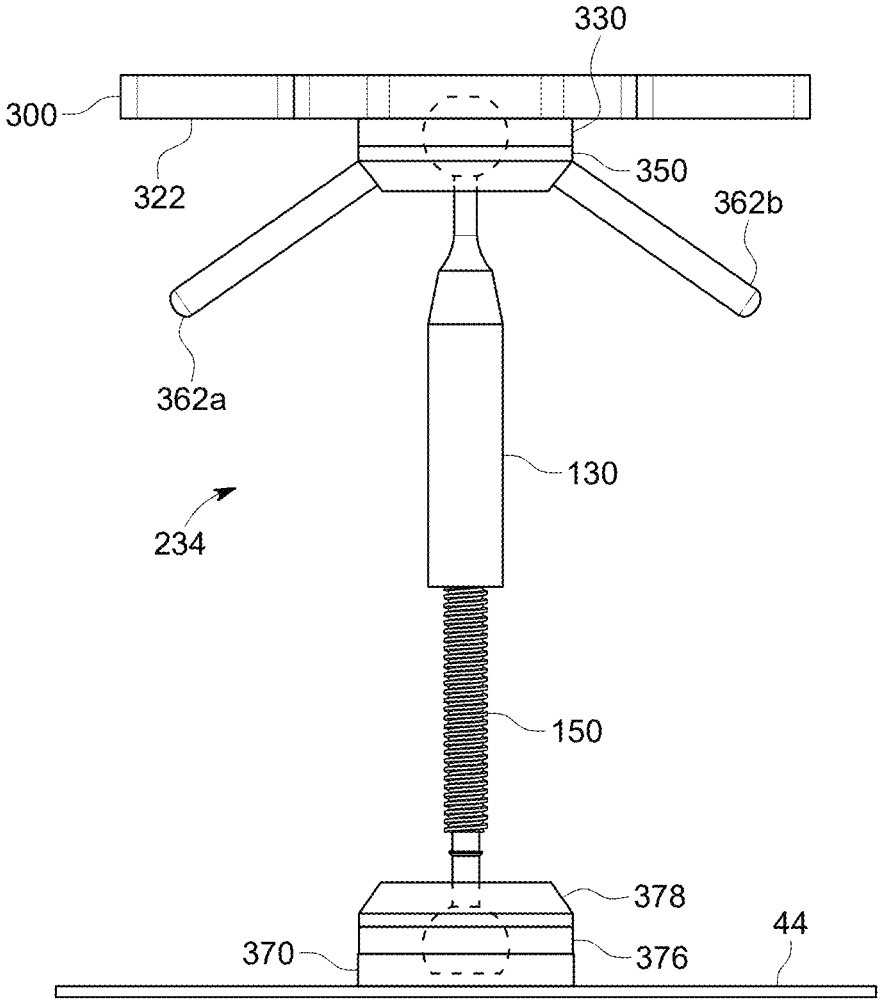
FIG. 23 is an assembled view of the multi-pivot suspension system of FIG. 22.
Figure 24:
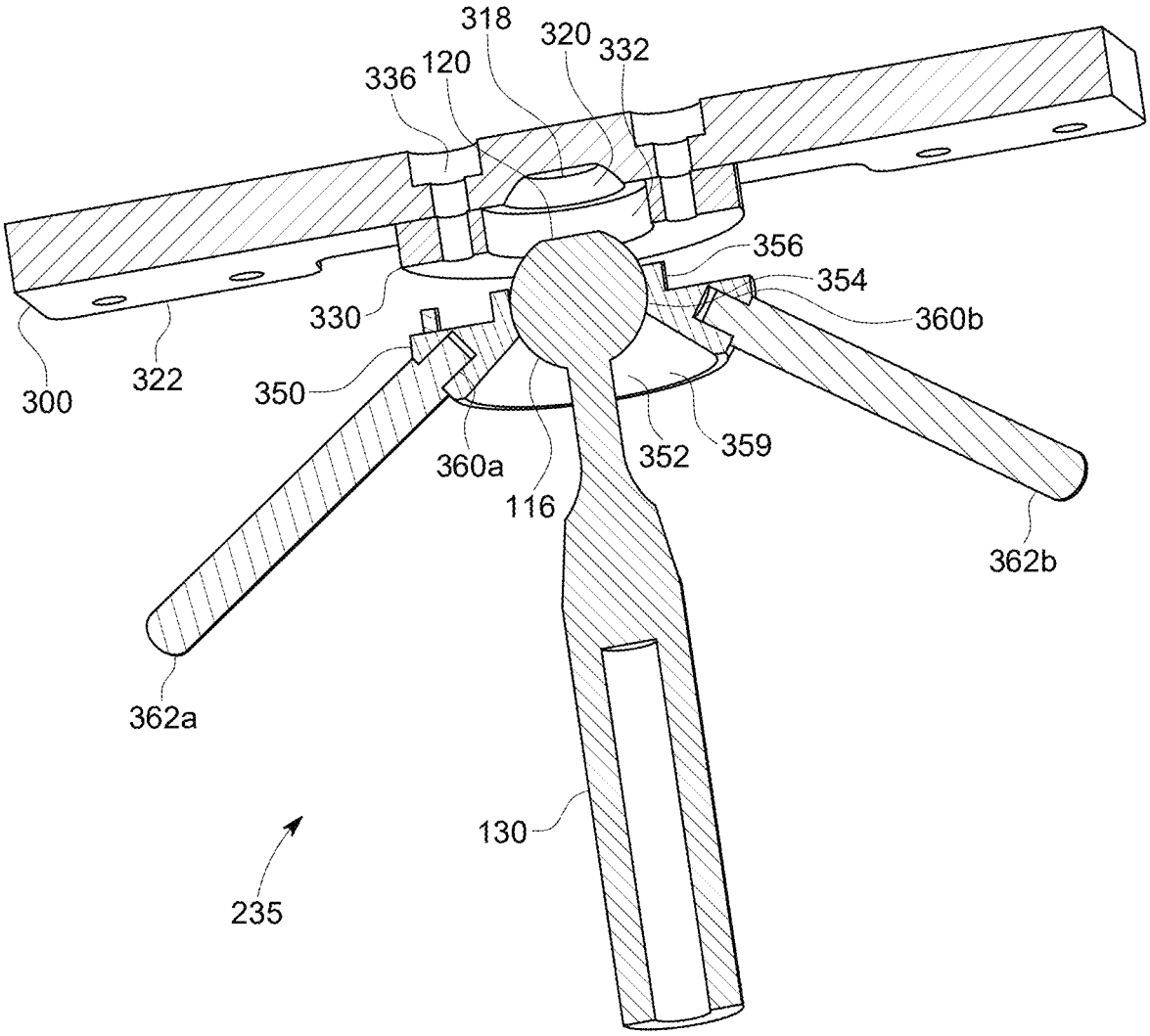
FIG. 24 is a tilted cross-sectional view of the upper portion of the multi-pivot suspension system of FIG. 22.
Figure 25:
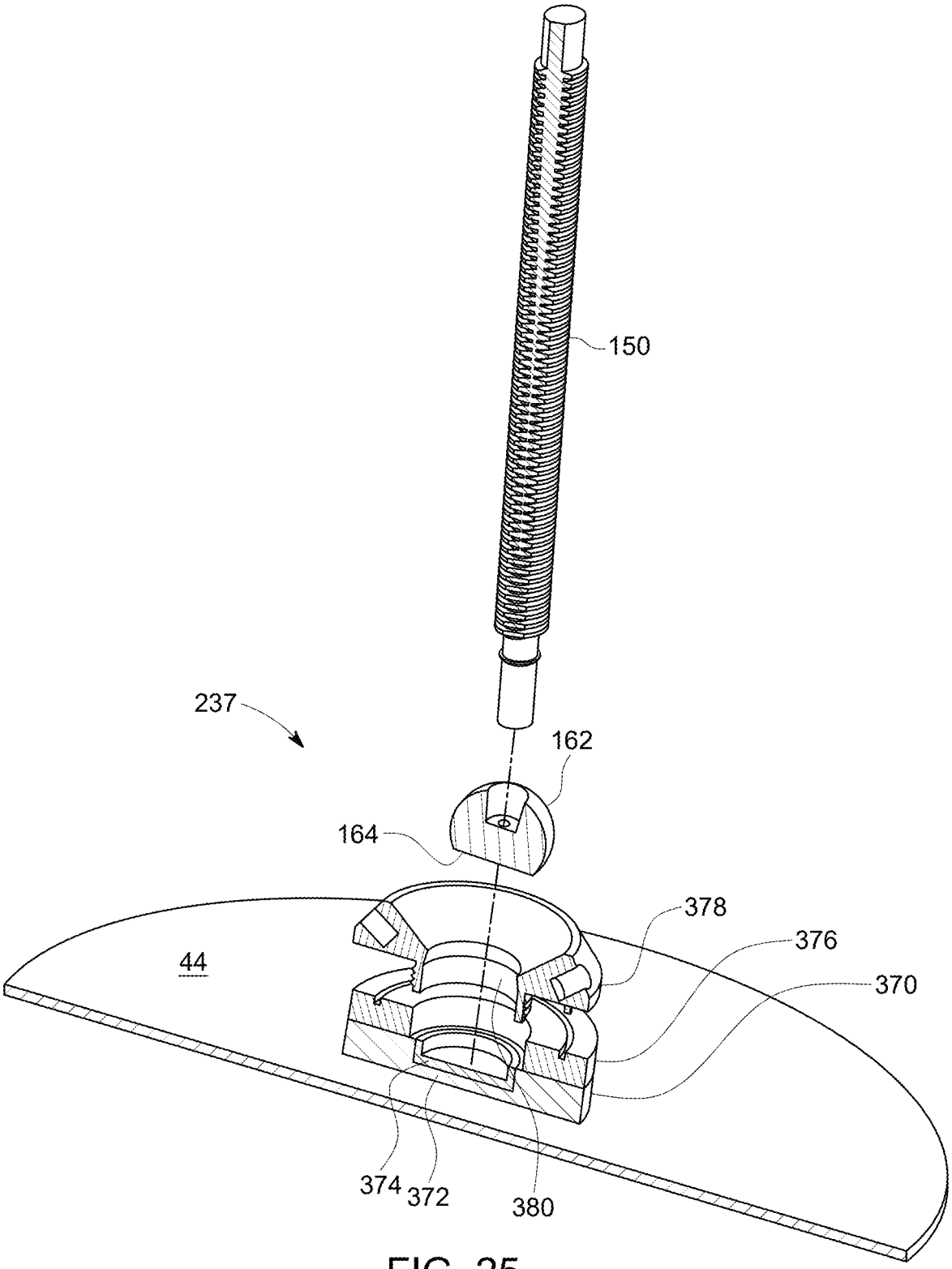
FIG. 25 is a tilted cross-sectional view of the lower portion of the multi-pivot suspension system of FIG. 22.

Turning now to FIGS. 22-23 and 25, the lower portion 237 of the alternative multi-pivot suspension system 234 will now be described. The lower portion is essentially the same as the upper portion 235 but inverted. The primary difference is that the lower portion includes a much simpler circular fastening plate 370 with a set of throughbores (not shown) for fastening to the top plate 44 (FIG. 1) of the pendulum bob 32 using a set of suitable fasteners. It will be appreciated that the fastening plate 370 may also be a unitary construction with the top plate. The fastening plate 370 also includes a central recess 372 for receiving a lower receptacle cup or insert 374 serving the same purpose as the upper portion cup 316. Positioned atop and secured to the fastening plate 370 is the first locking mechanism or lower female coupler 376 constructed in the same manner as the upper female coupler 330 with a threaded internal recess, C-shaped channel, and opposing nipples but inverted in relationship to the upper female coupler when assembled. As with the upper portion 235, the lower portion 237 also includes a lower male coupler 378 constructed in the same manner as the upper male coupler 350 with a hollowed threaded post, surrounding range of motion collar, and spring loaded pin but also inverted in relationship to the upper male coupler when assembled. A lower ball 162 (same as in FIGS. 9 and 11) with a lowermost flat surface 164 is cradled within the complementary ball seat 380 of the lower male coupler 378. The lower ball may include a threaded receptacle for threaded receipt of an end post of the long support rod 152 as in the prior embodiment (same as in FIG. 9) or the ball, end post, and long support rod may be of unitary construction. Together, the lower ball 162 and lower male coupler 378 define a second ball and socket joint within the multi-pivot suspension system 234.

It will be appreciated that the threaded long support rod 152 of the lower portion 237 threads into the extension and retraction sleeve of the upper portion 235 as with the suspension system 34 described above to couple the upper and lower portions together as shown in FIG. 11 for example. While a compression sleeve 182 (as in FIG. 11, for example) is not shown in FIGS. 22-26, it will be appreciated that such sleeve 182 may be used with the alternative multi-pivot suspension system 234 as well.

The remainder of the overall variable stroke fitness and therapy system includes a pendulum bob 32 that is the same as that shown in FIGS. 1-8 for example and described above.

To assemble and use the variable stroke fitness and therapy system 30 incorporating the alternative multi-pivot suspension system 234, the user may secure the fastening plate 370 of the lower portion 237 to the top plate 44 of the pendulum bob 32 using a set of screws, bolts, or other suitable fasteners. The top plate may then be fastened to the pendulum body if not already completed. Then, the lower cup 374 is friction fit into the central recess 372 of the fastening plate 370. The lower female coupler 376 may also be secured to the fastening plate 370 using suitable fasteners. Alternatively, it will be appreciated that the fastening plate, cup, and lower female coupler may be fastened as a unit to the top plate 44. The threaded rod 152 with the lower ball is inserted through the lower male coupler 378. The threaded post of the lower male coupler may then be threaded into the female coupler. After one or more turns of the lower male coupler relative to the female coupler, the spring loaded pin engages the first nipple in the lower female coupler 376. At this point, the flat surface 164 of the lower ball 162 is spaced apart from the flat surface of the lower cup 374 and defines an unlocked configuration or position allowing for freedom of movement of the lower ball within the lower ball and socket joint. However, turning the male coupler further along almost a complete three hundred sixty arc results in the spring loaded pin engaging the second nipple in the lower female coupler 376. At this point, the flat surface of the 164 of the lower ball 162 is abutting the flat surface of the lower cup, defining a locked configuration or position, effectively locking the lower ball and socket joint in place.

Turning to the upper portion 235 of the multi-pivot suspension system 234, the upper mounting plate 300 receives the upper cup 316 within the central recess 332. The upper female coupler 330 is fastened to the mounting plate using suitable fasteners. As a unit, the mounting plate, cup, and upper female coupler may be fastened to the overhead support structure 36 using the appropriate throughbore sets or strap regions. The extension and retraction sleeve 130 with the upper ball 116 attached is slipped through the central opening 352 of the upper male coupler 350 to nest the upper ball 116 within the upper ball seat 354. The sleeve 130 is then threaded onto the long support rod 150 to connect the upper portion 235 and lower portions 237 together. The handles 362*a*, 362*b* may be inserted into their respective handle holes 360*a*, 360*b* in the upper male coupler 350. The entire unit consisting of the upper male coupler, extension and retraction sleeve, elongated threaded support road, lower portion, and pendulum bob may be hoisted using the handles to align the threaded post 356 of the upper male coupler 350 into threaded engagement with the threaded interior sidewall 334 of the upper female coupler 330. After one or more turns, the spring loaded pin 364 engages the first nipple 340*a* of the female coupling 330 to enter into the unlocked position, which allows the upper ball to move freely within the upper ball and socket joint. In this exemplary embodiment, the spring loaded pin 364 reaches and engages the first nipple 340*a* five turns after the male coupler initially engages the female coupler. The spring loaded pin is at the deepest point in the C-shaped channel 338 at this point. It will be appreciated that the use of the spring loaded pin, once engaged with the unlocked position nipple (first nipple 340*a* for example) in the upper and lower portions also prevents the male coupler from completely unthreading from the female coupler until the pin is moved or bumped out of the way and no longer interferes with continued rotation of the male coupler relative to the female coupler. Such features adds a measure of safety to ensure the male coupler cannot fully release from the female coupler until the user moves the interfering pin out of the way. Using the handles to further turn the male coupler 350 relative to the female coupler 330 through an almost complete three hundred sixty degree arc results in the spring loaded pin 364 following the C-shaped channel 338 which gradually decreases in depth as the male coupler approaches a flush configuration with the female coupler. As the male coupler is rotated, the upper ball also travels upwardly through the female coupler causing the flat surface 120 to approach the flat surface 318 of the cup 316. Once the male coupler is almost rotated the entire three hundred and sixty degrees, the pin 354 engages the second nipple 340*b* and the upper ball and socket joint assumes a locked position. The spring loaded pin is at its most shallow position within the C-shaped channel at this point. Also, at this point, the flat surface 120 of the upper ball 116 abuts the flat surface 318 of the upper cup 316 thus locking the upper ball and socket joint at the upper pivot point. At this point in this example, the pendulum bob 32 is suspended from the overhead support structure 36 with both the upper and lower ball and socket joints locked thus presenting a fixed structure with no freedom of movement. The handles 362*a*, 362*b* may be removed from the upper male coupler 350 if desired.

To unlock one or both of the ball and socket joints, the selected upper or lower male coupler may be rotated relative to the respective female coupler back until the spring loaded pin engages the corresponding first nipple. Such action displaces the flat surface of the respective upper or lower ball from the respective flat surface in the upper or lower cup thus allowing for freedom of motion in both a rotation and swinging arc about the unlocked pivot point. It will be appreciated that, during assembly and suspension of the variable stroke fitness and therapy system, the user may elect to simply leave either or both pivot points (upper and lower ball and socket joints) unlocked initially instead of locking both and then selectively unlocking the desired pivot point or points. It will further be appreciated that the pendulum bob 32 may rotate even if one or both pivot points are locked to alter the length of the multi-point suspension system 234.

It is preferable to unlock at least one pivot point (upper or lower ball and socket joint) during use. Unlocking only the upper pivot point results in generating more resistance imparted on the user interacting with the pendulum bob due to the wider swing arc and longer lever arm. Unlocking only the lower pivot point results in a decreased resistance imparted to the user interacting with the pendulum bob relative to unlocking the upper pivot point. Unlocking only the lower pivot point may also prove useful if the space around the pendulum bob is limited. Unlocking both pivot points provides an additional variety of movement about two pivot points and resulting resistance adding a different set of interaction challenges. In addition, rotating the pendulum varies the length of the suspension system 34, 234 thus providing yet another interaction, load, and resistance variable. Overall, a variable stroke fitness and therapy system 30 substituting the alternative multi-pivot suspension system 234 for the earlier described multi-pivot suspension system 34 behaves similarly in operation, with only the portions of the assembly, and subsequent suspension, locking and unlocking activities being slightly different.

Such examples of exercise, fitness, and therapy motion routines are merely a small snapshot of the ever expanding variety of pendulum bob 32 interactive motions and activities that may be employed when using the variable stroke fitness and therapy system 30. As discussed above, a single user may interact directly or indirectly with the pendulum bob 32. In addition, a plurality of users may engage the pendulum bob taking positions one opposite, adjacent, or skewed sides of the outer shell 42. The pendulum bob may be struck, kicked, pushed, pulled, swung, spun, shaken, tilted, or other interactive motion. It will be appreciated that the range of motions allowed by the variable stroke fitness and exercise system 30 and variable resistances offered by the system enables a user to replace a multitude of exercise machines in a very limited space. It will further be appreciated that the accessory bar 218 is preferably used for pushing, pulling, twisting, and shaking motions in direct contact with the pendulum bob 32 while the accessory strap 222 is preferably used for pulling and release motions. In addition, the accessory bar may be attached to the pendulum bob via an accessory strap as well to provide more distance from the pendulum bob. However, the user may develop their own preferences for each pendulum bob interactive exercise and/or fitness activity.

In addition, the system 30 is much less complicated and more intuitive than most machines found in gym and exercise settings. Safety is also improved versus heavy gym machinery where large plates, dumbbells, insertion pins, and snap back handles may strike the user if not used correctly. In this system, the outer shell 42 is relatively soft and forgiving. The size and weight of the pendulum bob may be varied as may the density and/or material of the outer shell 42. The system 30 is highly portable and may be set up anywhere there is an overhead support structure including, for example, a support arm in the back of a truck that may be useful for military fitness exercises in remote locations.

In addition to performing a single fitness or therapy exercise, the user may flow from one routine to the next simply by varying their proximity to the pendulum or changing their orientation relative to the pendulum bob 32. The accessories also facilitate changing from one exercise to another by simply changing distance, position and/or orientation relative to the pendulum bob as the user is not fixed in a particular location as with an exercise machine bench. The user may also maintain contact with the pendulum bob when flowing from one exercise to another, either directly or through an accessory, or may break contact before changing position. While focusing on muscle groups is a key focus of the system, a prolonged sequence of motions invokes cardio development as well. In addition, the user may practice repetitive muscle memory athletic motions such as, for example, a tennis swing, golf swing, punching, kicking, throwing an object, or catching an object. Overall, the range of exercise and fitness routines available using the variable stroke fitness and exercise system 30 facilitate improved hand-eye coordination, timing and reaction speed, proprioception, cardio output, muscle memory and strength building, as well as improved balance and stability among other exercise and fitness generating results.

Yet another benefit of the system 30 is the focus on maintaining a balanced position during a routine. Once the user finds a balanced position, the swing of the pendulum bob and interaction therewith challenges the user to maintain such balanced position resulting in a number of muscle groups acting together to maintain stability and equilibrium.

In view of the foregoing, at least one object supported by one or more embodiments described herein is to provide fitness and therapy system with a multi-pivot point suspension system for suspending a workout form or pendulum bob from an overhead support structure. In some embodiments, the suspension system incorporates an upper socket constructed to be secured to an overhead support, an upper ball member constructed to be pivotally retained within the upper socket defining a first tilt axis and a lower ball member constructed to be pivotally retained within a lower socket defining a second tilt axis wherein the centerlines of the suspension system and pendulum bob may be aligned or misaligned during the swinging motion depending on the pivot points established by the suspension system.

In at least one embodiment, the suspension system may be locked in place at either or both the upper and lower ball and socket assemblies presenting a variety of pivot point combinations or a fixed pendulum.

In at least one embodiment, the suspension system may be rotated to increase or decrease its length resulting in a different stroke length.

In at least one embodiment, the suspension system incorporates a stop preventing one portion of the suspension system from being completely withdrawn from a complementary portion of the suspension system.

In at least one embodiment, the pendulum bob incorporates a number of anchor points about its exterior to provide a variety of attachment points for interactive accessories further increasing the number of routines that may be performed using the variable stroke fitness and therapy system.

In at least one embodiment, the pendulum bob is multi-faceted presenting a plurality of faceted surfaces with which to interact during use. The pendulum bob may also be tapered to allow for more room for floor based exercise. A recess may be incorporated into the pendulum bob to provide space for an anchor strap and/or electronics such as motion and/or location sensors with transmission capabilities for monitoring movement of the pendulum bob in use.

In at least one embodiment, a user may flow from one activity to another seamlessly with maintaining contact with the pendulum bob, either directly or indirectly using an accessory.

Certain objects and advantages in conjunction with the embodiments are described herein. Of course, it is to be understood that not necessarily all such objects or advantages may be achieved in accordance with any particular embodiment of the invention. Thus, for example, those skilled in the art will recognize that the invention may be embodied or carried out in a manner that achieves or optimizes one advantage or group of advantages as taught herein without necessarily achieving other objects or advantages as may be taught or suggested herein.

Although this invention has been disclosed in the context of certain preferred embodiments and examples, it will be understood by those skilled in the art that the present invention extends beyond the specifically disclosed embodiments to other alternative embodiments and/or uses of the invention and obvious modifications and equivalents thereof. In addition, while a number of variations of the invention have been shown and described in detail, other modifications, which are within the scope of this disclosure, will be readily apparent to those of skill in the art based upon this disclosure. Numbers such as weights, lengths, and widths provided herein are merely illusory and not meant to be limiting in any manner. Suitable material changes also fall well within the scope of the embodiments discussed herein.

It is also contemplated that various combinations or sub-combinations of the specific features and aspects of the embodiments may be made and still fall within the scope of the invention. Accordingly, it should be understood that various features and aspects of the disclosed embodiments may be combined with or substituted for one another in order to form varying modes of the disclosed invention. Thus, it is intended that the scope of the present invention herein disclosed should not be limited by the particular disclosed embodiments described above.

What is claimed is:

1. A variable stroke fitness and therapy system for suspending from an overhead support structure, the system comprising:

a pendulum bob having an elongated pendulum body including a lowermost free end to be suspended at an adjustable height above a lower surface, at least one external padded sidewall, and a top surface;

an elongated height adjustable pendulum bob support having an extension and retraction sleeve with an upper end and threadably connected to a lower support rod with a lower end, the pendulum bob support being responsive to rotation of the sleeve relative to the support rod to shorten or lengthen an overall length of the pendulum bob support;

an uppermost joint constructed to releasably connect the upper end of the sleeve to the overhead support structure, the uppermost joint defining an uppermost pivot point;

a lowermost joint constructed to releasably connect the lower end of the support rod to the top surface of the pendulum bob, the lowermost joint defining a lowermost pivot point, both the uppermost and lowermost joints being disposed between the top surface of the pendulum bob and the overhead support structure when secured thereto;

a first locking mechanism releasably engaging the uppermost joint, the first locking mechanism being selectively positionable between an uppermost joint locking orientation restricting the pendulum body from pivoting about the uppermost pivot point and an uppermost joint unlocking orientation allowing the pendulum body to swing freely through an arc relative to the uppermost pivot point; and a second locking mechanism releasably engaging the lowermost joint, the second locking mechanism being selectively positionable between a lowermost joint locking orientation restricting the pendulum body from pivoting about the lowermost pivot point and a lowermost joint unlocking orientation allowing the pendulum body to swing freely through an arc relative to the lowermost pivot point.

2. The variable stroke fitness and therapy system of claim 1 wherein:

the uppermost joint includes a first flat surface constructed to engage the first locking mechanism to lock the uppermost joint and prevent the pendulum body from swinging about a first swing arc relative to the uppermost joint; and the lowermost joint includes a second flat surface constructed to engage the second locking mechanism to lock the lowermost joint and prevent the pendulum body from swinging about a second swing arc relative to the lowermost joint.

3. The variable stroke fitness and therapy system of claim 2 wherein:

the first locking mechanism is a first puck inserted against the first flat surface of the uppermost joint to lock the uppermost pivot point; and the second locking mechanism is a second puck inserted against the second flat surface of the lowermost joint to a lock the lowermost pivot point.

4. The variable stroke fitness and therapy system of claim 1 wherein:

the first locking mechanism includes a first twisting element releasably securing an upper region of the extension and retraction sleeve to the overhead support structure; and the second locking mechanism includes a second twisting element releasably securing a lower region of the lower support rod to the top of the pendulum body.

5. The variable stroke fitness and therapy system of claim 1 wherein:

the external padded sidewall of the pendulum body is multi-faceted and tapers inwardly from the top surface to a bottom surface of the pendulum body.

6. The variable stroke fitness and therapy system of claim 1 wherein:

the pendulum body is a substantially hollow body constructed of a first solid material at least partially surrounded by an outer shell defining the external padded sidewall.

7. The variable stroke fitness and therapy system of claim 1 wherein:

the uppermost joint and the lowermost joint are constructed to both selectively lock in place to prevent any swinging motion of the pendulum body while still allowing for rotation of the pendulum body.

8. The variable stroke fitness and therapy system of claim 1 wherein:

the first locking mechanism is constructed to selectively lock the uppermost joint in place allowing the pendulum body to swing only through an arc about the lower pivot point.

9. The variable stroke fitness and therapy system of claim 1 wherein:

the second locking mechanism is constructed to selectively lock the lowermost joint in place allowing the pendulum body to swing only through an arc about the upper pivot point.

10. The variable stroke fitness and therapy system of claim 1 wherein:

the first and second locking mechanisms are constructed to selectively unlock the uppermost joint and the lowermost joint, respectively, allowing the pendulum body to swing through an upper arc about the upper pivot point and an independent lower arc about the lower pivot point.

11. The variable stroke fitness and therapy system of claim 1 wherein:

the first and second locking mechanisms are constructed to selectively lock about one or more pivot points to alter the load transferred to the pendulum body.

12. The variable stroke fitness and therapy system of claim 1 wherein:

the outermost surface of the pendulum body includes a plurality of spaced apart anchor points constructed to receive a device for interacting with the pendulum body.

13. The variable stroke fitness and therapy system of claim 1 wherein:

the lower support rod of the elongated pendulum bob support is constructed to travel between a fully extended position and a fully retracted position relative to the extension and retraction sleeve.

14. The variable stroke fitness and therapy system of claim 1 wherein:

a height differential from a bottom surface of the pendulum body and a surface over which the pendulum body is suspended may be altered by rotating the pendulum body to travel the lower support rod within the extension and retraction sleeve to change the overall length of the lower support rod and extension and retraction sleeve even with one or more of the joints locked in place by their respective locking mechanism.

15. The variable stroke fitness and therapy system of claim 1 wherein:

the outermost surface of the pendulum body includes a plurality of spaced apart pick points presenting interaction targets.

16. The variable stroke fitness and therapy system of claim 1 wherein:

the uppermost joint includes a ball and socket assembly allowing tilting and rotational motion of the pendulum body.

17. The variable stroke fitness and therapy system of claim 1 wherein:

the lowermost joint includes a ball and socket assembly allowing tilting and rotational motion of the pendulum body.

18. The variable stroke fitness and therapy system of claim 1 wherein:

locking the uppermost joint imparts a first load profile to the user while the pendulum is swinging or being contacted; and locking the lowermost joint imparts a second load profile to the user while the pendulum is swinging or being contacted.

19. A variable stroke fitness and therapy system for suspending from an overhead support structure, the system comprising:

a pendulum bob having an elongated pendulum body including a lowermost free end to be suspended at an adjustable height above a lower surface, at least one external padded sidewall, and a top surface;

an elongated height adjustable pendulum bob support removably coupled to the top surface of the pendulum body, the pendulum bob support having a first support member rotationally engaged with a second support member, the pendulum bob support being responsive to rotation of one of the support members relative to the other support member to shorten or lengthen an overall length of the pendulum bob support;

at least one multi-directional joint removably coupled to at least a portion of the pendulum bob support and defining a pivot point disposed between the top surface of the pendulum bob and the overhead support structure when releasably secured thereto; and at least one locking mechanism selectively positionable between a joint locking orientation restricting the pendulum body from pivoting about the pivot point and a joint unlocking orientation allowing the pendulum body to swing freely through an arc relative to the pivot joint.

20. A variable stroke fitness and therapy system for suspending from an overhead support structure, the system comprising:

a pendulum bob having an elongated pendulum body including a lowermost free end to be suspended at an adjustable height above a lower surface, at least one external padded sidewall, and a top surface;

an elongated height adjustable pendulum bob support having a first support member with an upper end and threadably engaged with a second support member with a lower end, the pendulum bob support being responsive to rotation of one of the support members relative to the other support member to shorten or lengthen an overall length of the pendulum bob support;

an upper multi-directional joint removably coupled to the upper end of the pendulum bob support and defining an upper pivot point, the upper multi-directional joint constructed to releasably connect the pendulum bob support to the overhead support structure;

a lower multi-directional joint removably coupled to the lower end of the pendulum bob support and defining a lower pivot point, the lower multi-directional joint constructed to releasably connect the pendulum bob support to the top surface of the pendulum body, both of the joints being disposed between the top surface of the pendulum body and the overhead support structure when releasably secured thereto;

at least one locking mechanism selectively positionable between a first joint locking orientation restricting the pendulum body from pivoting about the upper pivot point, a second joint locking orientation restricting the pendulum body from pivoting about the lower pivot point, a dual locking orientation restricting the pendulum from pivoting about either pivot point, and a joint unlocking orientation allowing the pendulum body to swing freely through a pair of independent arcs relative to both pivot points; and wherein the height adjustable pendulum bob support, the upper and lower joints, and the at least one locking mechanism cooperate to selectively allow the pendulum body to be locked in place, swing through one or more independent swing arcs, and rotate to adjust the distance between the top surface of the pendulum body and the overhead support structure when releasably secured thereto.

* * * * *